US011060787B2

(12) United States Patent
Seo

(10) Patent No.: US 11,060,787 B2
(45) Date of Patent: Jul. 13, 2021

(54) REFRIGERATOR

(71) Applicant: LG ELECTRONICS INC., Seoul (KR)

(72) Inventor: Hyunwoo Seo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 34 days.

(21) Appl. No.: 16/664,281

(22) Filed: Oct. 25, 2019

(65) Prior Publication Data

US 2020/0141629 A1 May 7, 2020

(30) Foreign Application Priority Data

Nov. 1, 2018 (KR) ..... 10-2018-0132675

(51) Int. Cl.
*F25D 23/00* (2006.01)
*F25D 23/06* (2006.01)

(52) U.S. Cl.
CPC ..... *F25D 23/067* (2013.01); *F25D 23/003* (2013.01); *F25D 23/006* (2013.01); *F25D 23/062* (2013.01); *F25D 2323/00261* (2013.01); *F25D 2323/00267* (2013.01); *F25D 2323/00271* (2013.01); *F25D 2323/00277* (2013.01)

(58) Field of Classification Search
CPC .... F25D 23/067; F25D 23/003; F25D 23/006; F25D 23/062; F25D 2323/00261; F25D 2323/00267; F25D 2323/00271; F25D 2323/00277; F25D 31/006; F25D 2400/06
USPC ..... 312/213, 401, 406, 406.2; 62/411; 248/903, 27.1, 201
See application file for complete search history.

(56) References Cited

U.S. PATENT DOCUMENTS 2,743,981 A * 5/1956 Moore ..... F25D 23/006 312/401
9,939,189 B2 * 4/2018 Koo ..... F25D 23/006
(Continued)

FOREIGN PATENT DOCUMENTS

CN 105928299 9/2016
CN 106679308 5/2017
(Continued)

OTHER PUBLICATIONS

KR2019142994 ; Cho et al; figure and abstract (Year: 2019).*
(Continued)

*Primary Examiner* — Janet M Wilkens
(74) *Attorney, Agent, or Firm* — Ked & Associates, LLP

(57) ABSTRACT

A refrigerator an outer case that forms an outer appearance of a cabinet in which a storage space is formed, a machine chamber provided at a lower end of a rear surface of the cabinet and independent of the storage space, the machine chamber being configured to receive a compressor and a condenser, frame assemblies provided at lower ends of both side surfaces of the outer case, and a main plate provided between the frame assemblies, the main plate forming the machine chamber, in which the frame assembly includes a reinforcement frame provided along a lower end and a rear edge of the outer case; and a reinforcement bracket coupled to the reinforcement frame and provided along circumferences of both side surfaces of the machine chamber in a left and right direction.

20 Claims, 19 Drawing Sheets

(56) References Cited

U.S. PATENT DOCUMENTS

| | | | | |
|---|---|---|---|---|
| 2015/0159934 | A1* | 6/2015 | Choi | F25D 23/061 62/344 |
| 2016/0069595 | A1* | 3/2016 | Kim | F25D 23/003 62/498 |
| 2020/0166271 | A1* | 5/2020 | Hosamani | F25D 23/067 |
| 2020/0200467 | A1* | 6/2020 | Park | F25D 27/00 |

FOREIGN PATENT DOCUMENTS

| | | | |
|---|---|---|---|
| DE | 1 451 099 | | 3/1969 |
| DE | 102011002777 | * | 7/2019 |
| EP | 2878905 | * | 6/2015 |
| JP | S56-50987 | | 5/1981 |
| JP | 2007-003180 | | 1/2007 |
| JP | 2009-156497 | | 7/2009 |
| JP | 2015-001344 | | 1/2015 |
| KR | 20-1990-0001181 | | 2/1990 |
| KR | 10-2015-0063175 | | 6/2015 |
| WO | 2014201892 | * | 12/2014 |
| WO | 2020141764 | * | 7/2020 |

OTHER PUBLICATIONS

European Search Report dated Mar. 6, 2020 issued in EP Application No. 19205737.0.

Korean Office Action dated May 15, 2020 issued in KR Application No. 10-2018-0132675.

* cited by examiner

REFRIGERATOR

CROSS-REFERENCE TO RELATED APPLICATION

This application claims priority under 35 U.S.C. § 119 to Korean Application No. 10-2018-0132675 filed on Nov. 1, 2018, whose entire disclosure is hereby incorporated by reference.

BACKGROUND

1. Field

The present disclosure relates to a refrigerator.

2. Background

In general, a refrigerator is a home appliance that allows food to be stored at a low temperature in an internal storage space shielded by a door. To this end, the refrigerator is configured to cool the internal storage space by using cold air generated by heat exchange with the refrigerant circulating in the refrigeration cycle, so that the stored foods can be optimally stored.

In the structure of a general refrigerator, a machine chamber in which components such as a compressor and a condenser for driving a refrigeration cycle are disposed may be provided separately from the storage space. On the other hand, in a case of the machine chamber, interior space thereof is empty, a plurality of flow passages of the cold air can be formed for the cooling of the components inside the machine chamber.

The machine chamber has a hollow structure and has a structure that is structurally vulnerable to strength due to air flow passages. This structural weakness can cause deformation of the side surface where the machine chamber is placed due to shock during transportation or installation of the refrigerator.

In order to solve this problem, in Korean Patent Laid-Open Publication No. 10-2015-0063175, a structure for allowing cold air to enter and exit the machine chamber by heat-insulating material being injected into the side wall of the machine chamber to reinforce the side strength of the machine chamber and by being provided with a flow path device which is embedded in the heat-insulating material of the side wall of the machine chamber is disclosed.

However, such a related art has a structure in which the foaming liquid for forming the heat-insulating material is hard to be completely filled on the side wall surface of the machine chamber, and thus there is a problem that reinforcement of the side strength of the machine chamber is not effective.

In addition, when the heat-insulating material is filled in the side wall of the machine chamber, the heat dissipation performance of the inside of the machine chamber is lowered, which may cause an increase in power consumption.

In addition, when the flow path device is increased to improve the heat dissipation efficiency of the machine chamber, the strength reinforcement performance of the machine chamber decreases, and when the flow path device is reduced to improve the strength reinforcement performance of the machine chamber, there are problems that the heat dissipation performance decreases and power consumption increases.

In particular, if it is intended that storage capacity and insulation performance inside the refrigerator are secured by decreasing the size of the machine chamber, these problems may be more serious.

The above reference is incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Figure 1:
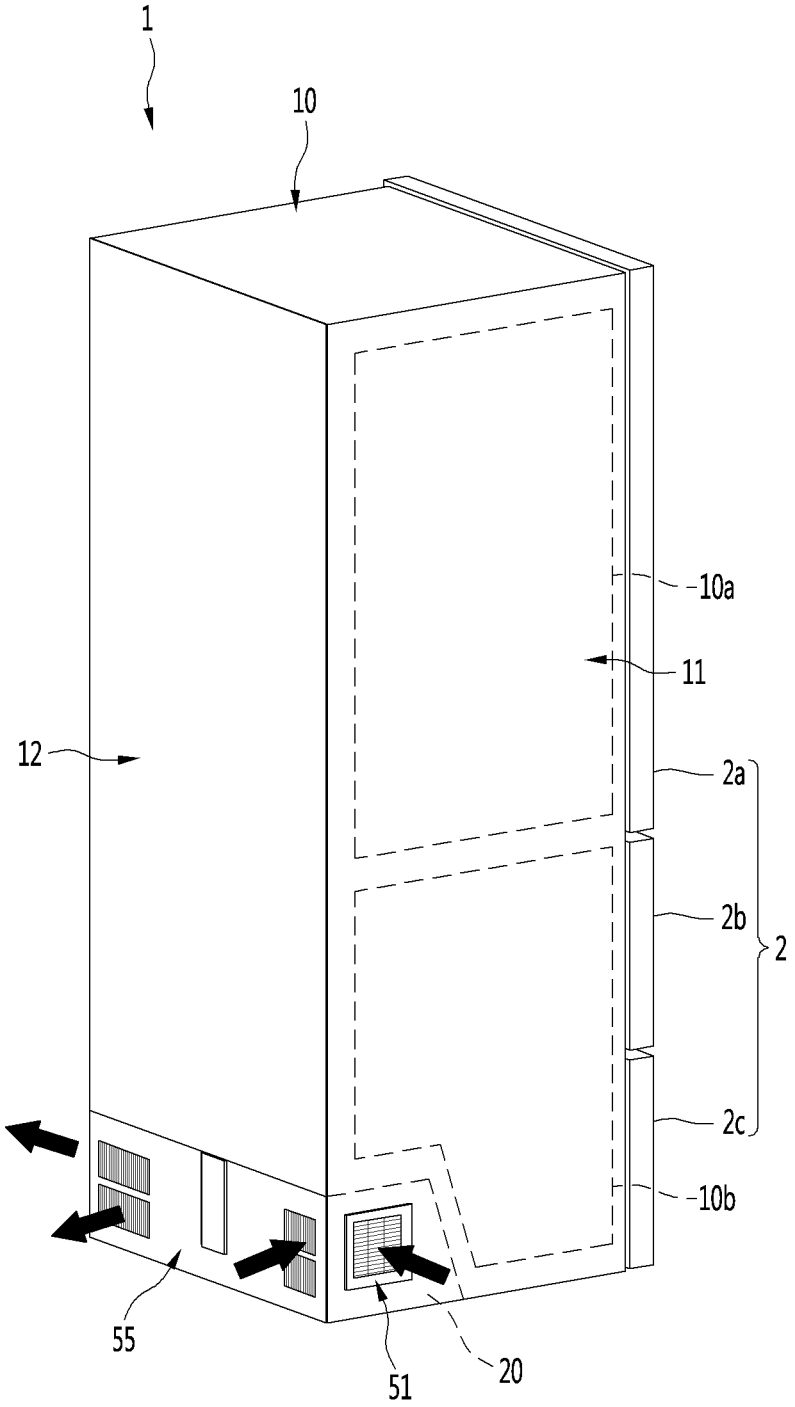
FIG. 1 is a perspective view illustrating the refrigerator according to an embodiment of the present disclosure viewed from the rear.
Figure 2:
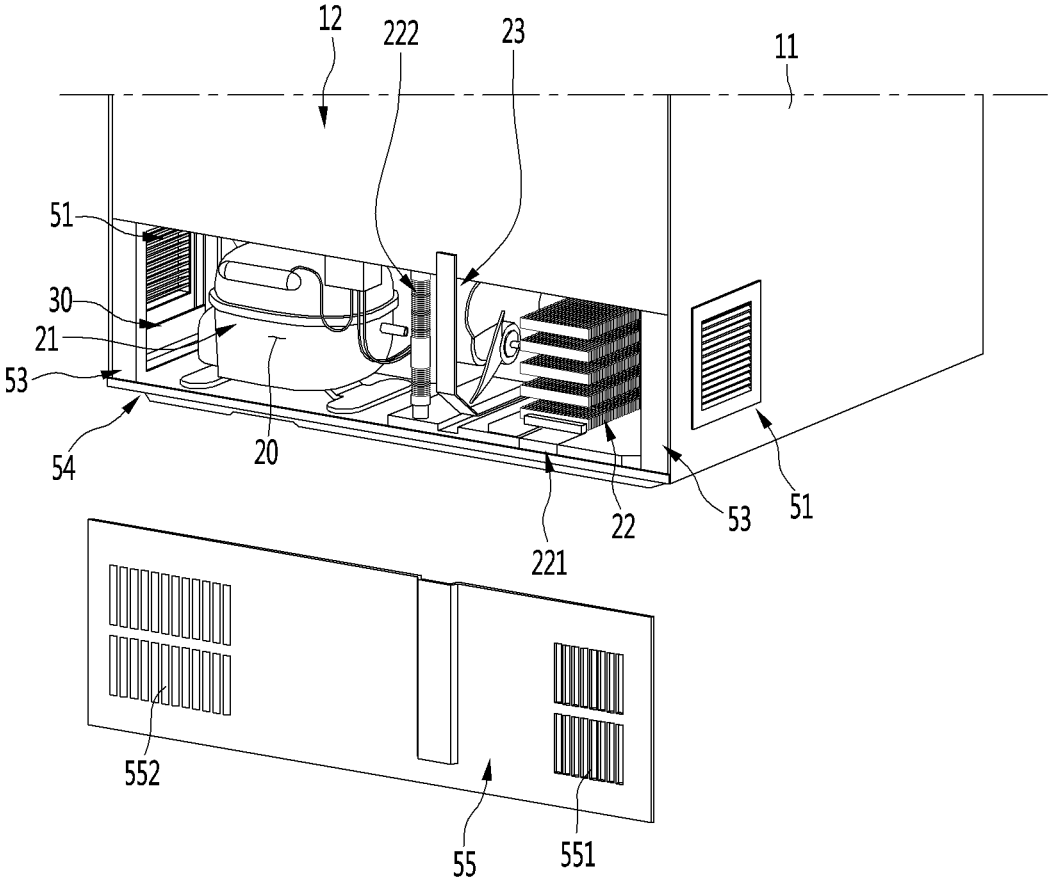
FIG. 2 is an exploded perspective view illustrating a state where a machine chamber cover of the refrigerator is separated.
Figure 3:
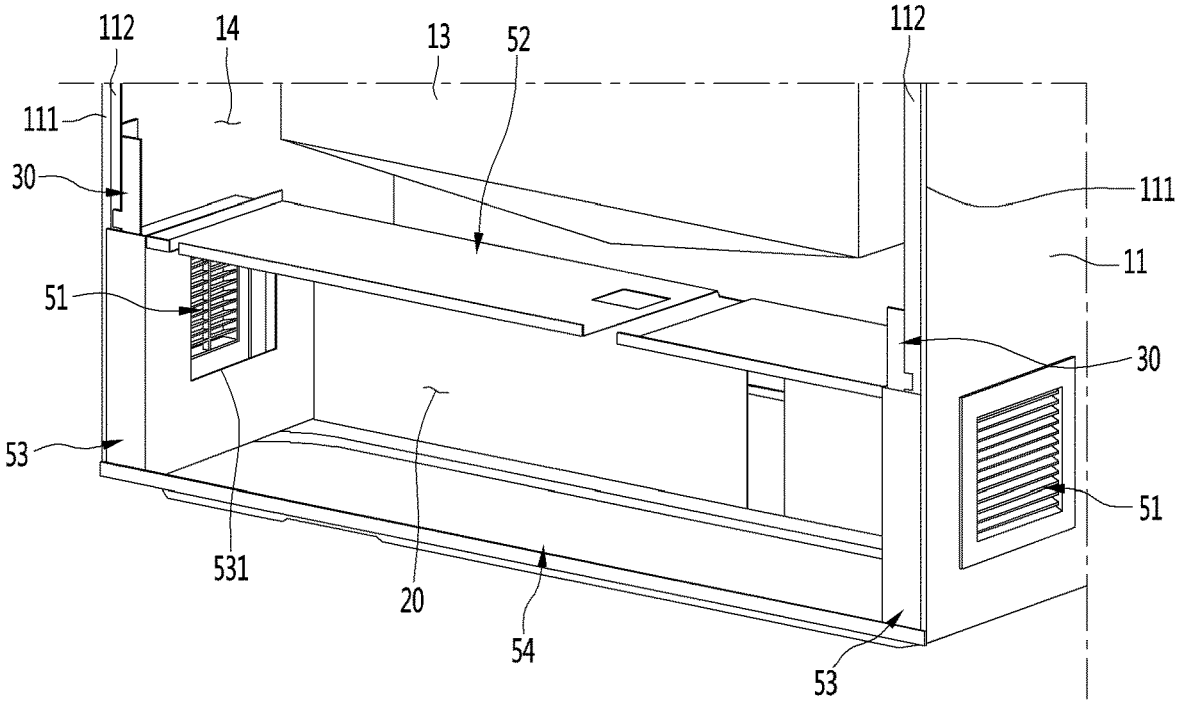
FIG. 3 is a partial perspective view illustrating space inside the machine chamber of the refrigerator.
Figure 4:
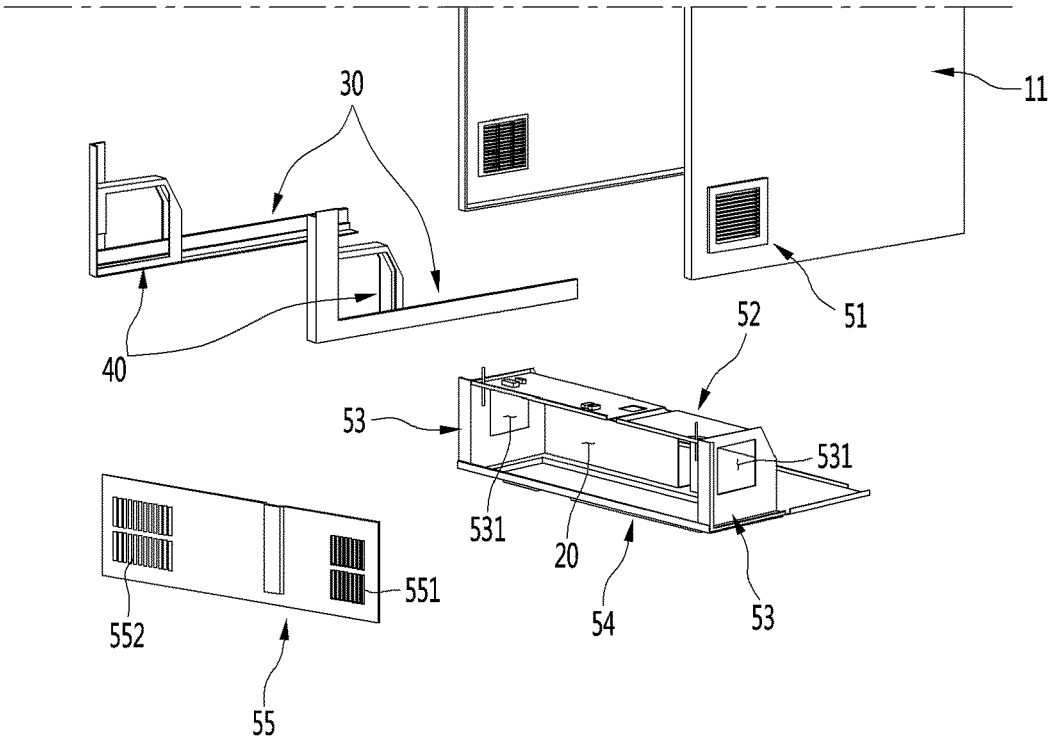
FIG. 4 is an exploded perspective view illustrating a coupling structure of the out case, the frame assembly, and the machine chamber module of the refrigerator.
Figure 5:
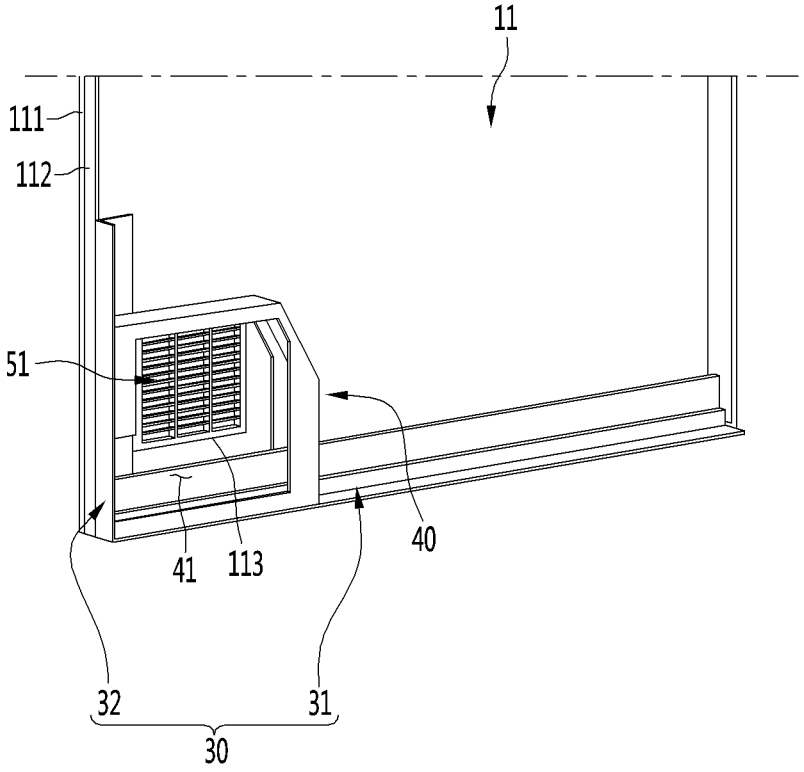
FIG. 5 is a partial perspective view illustrating a coupling state of the out case and the frame assembly.
Figure 6:
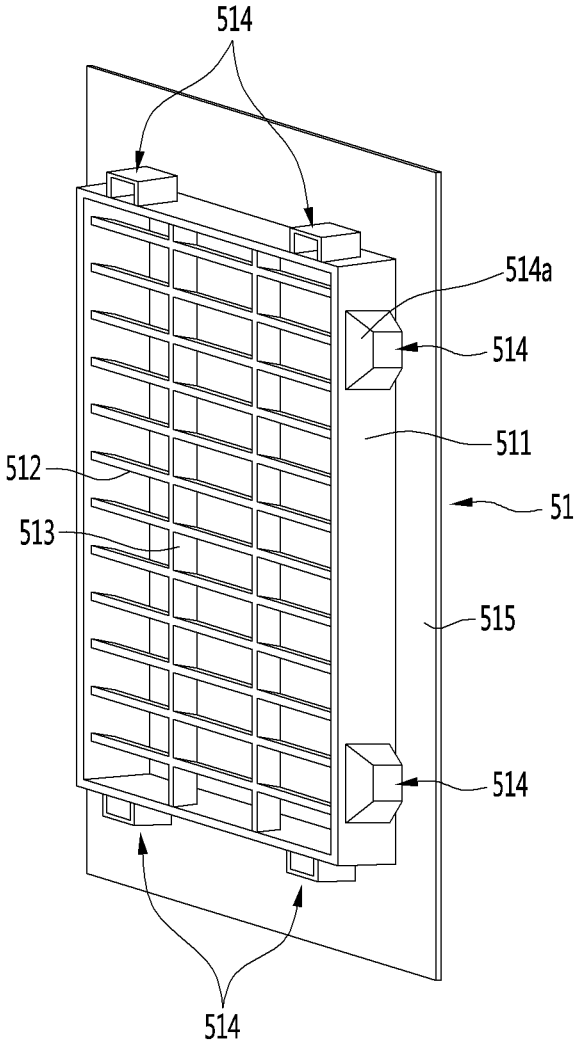
FIG. 6 is a perspective view illustrating a side grill of the refrigerator.
Figure 7:
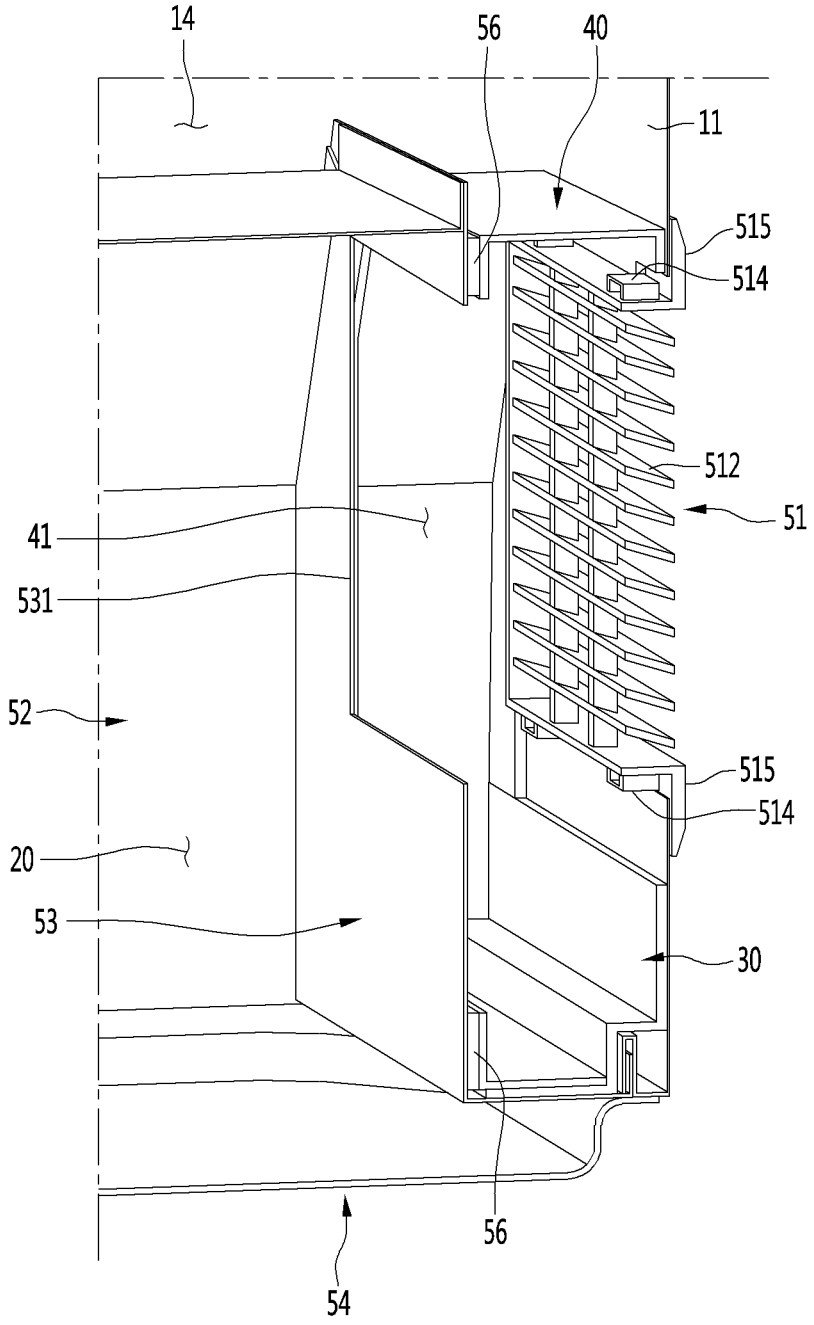
FIG. 7 is a partial cutaway perspective view illustrating one side of the side surface of the machine chamber in a state where the side grille is coupled.
Figure 8:
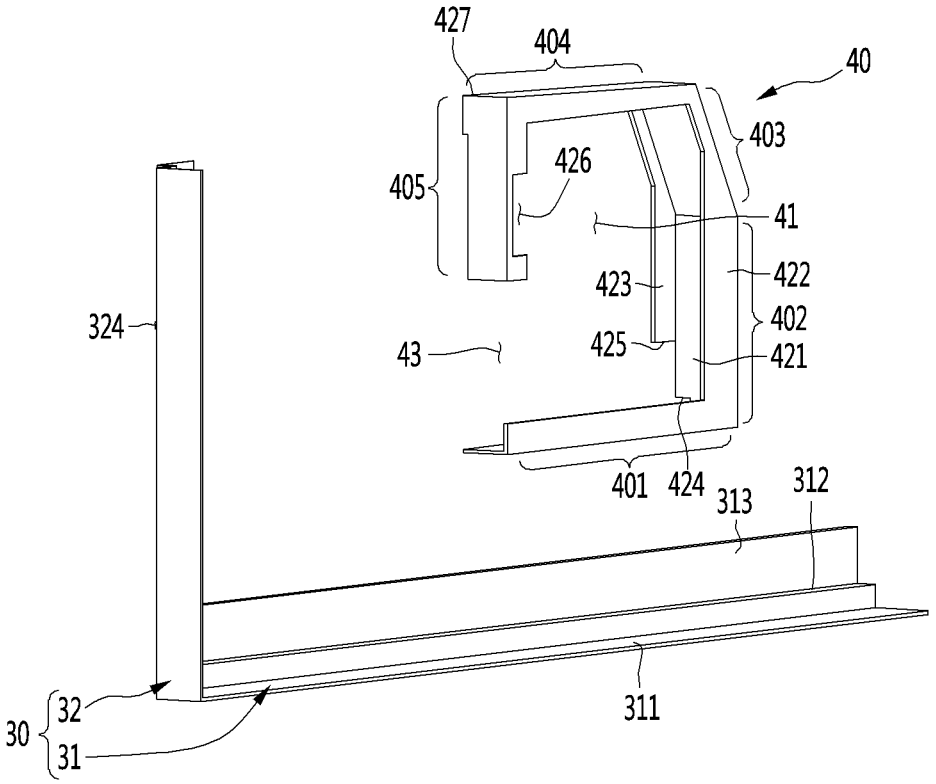
FIG. 8 is an exploded perspective view illustrating the coupling structure of the frame assembly viewed from one side.
Figure 9:
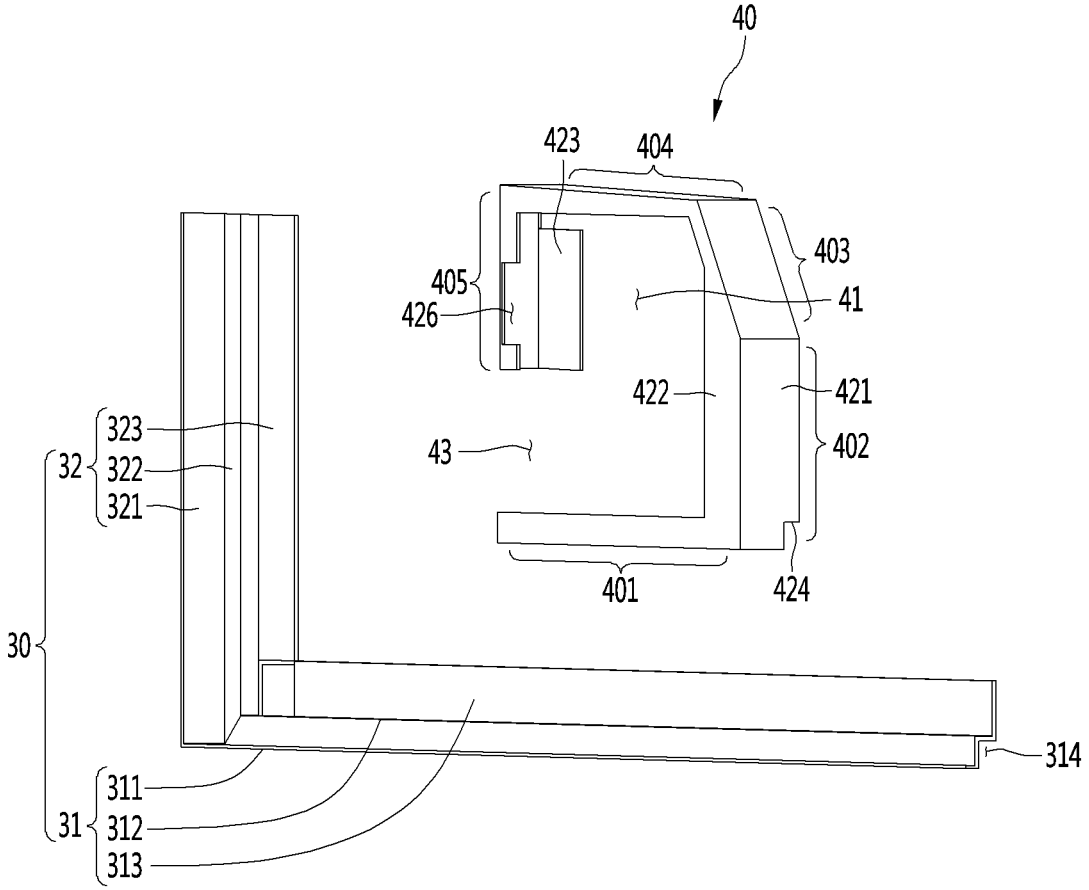
FIG. 9 is an exploded perspective view illustrating the coupling structure of the frame assembly viewed from the other side.
Figure 10:
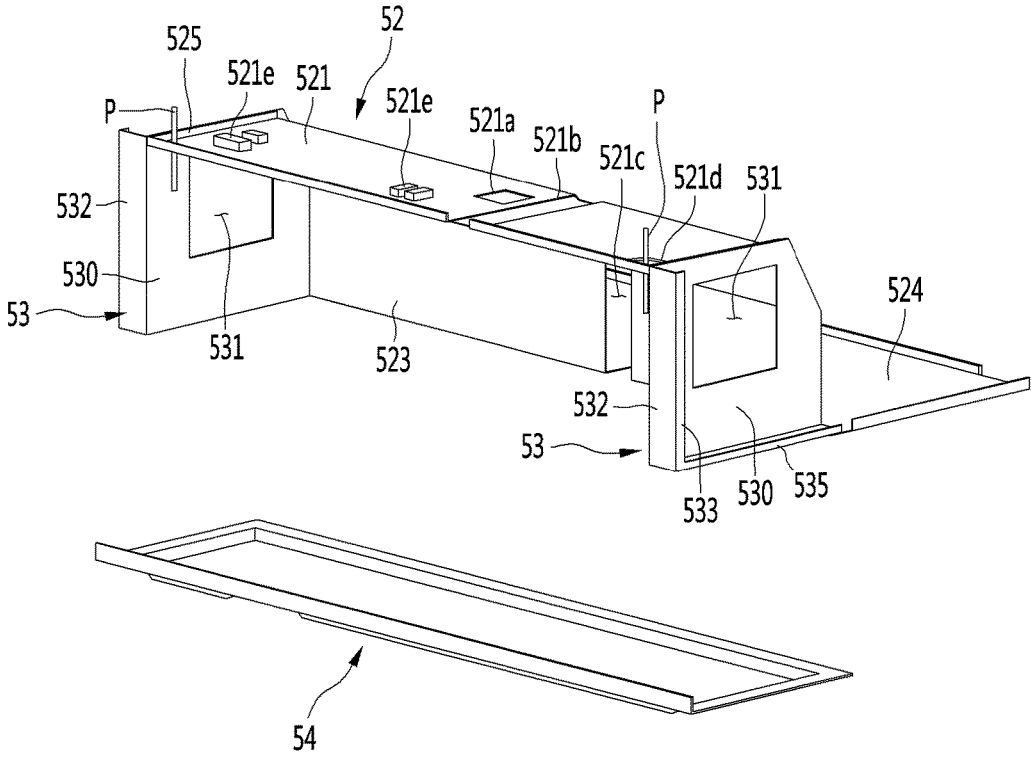
FIG. 10 is an exploded perspective view illustrating a state where the base of the machine chamber module is separated.
Figure 11:
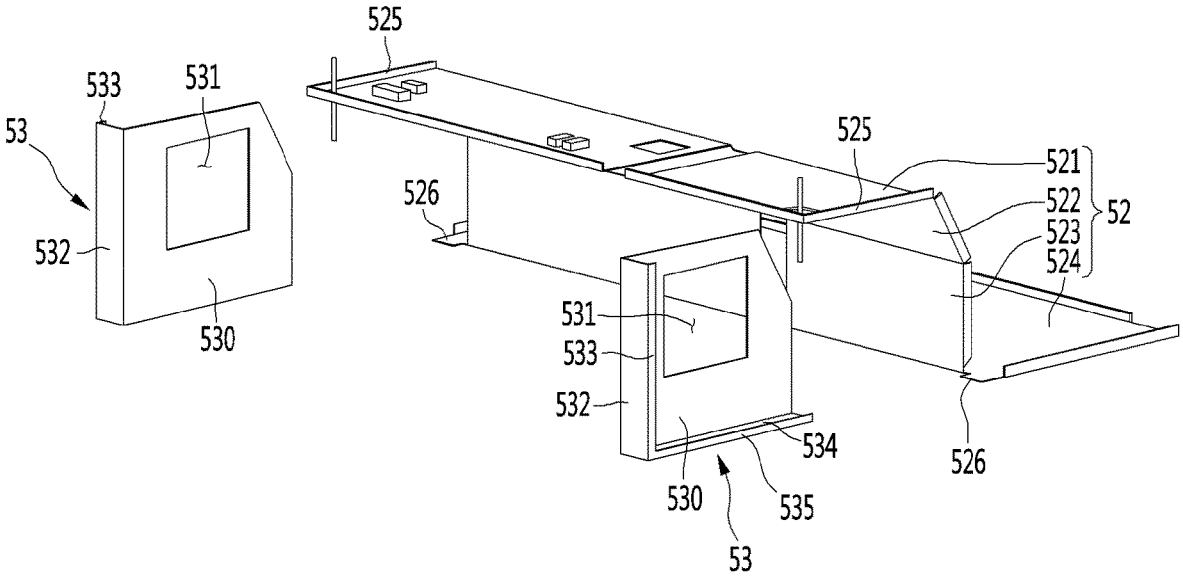
FIG. 11 is an exploded perspective view illustrating a coupling structure of the main plate and the side cover of the machine chamber module.
Figure 12:
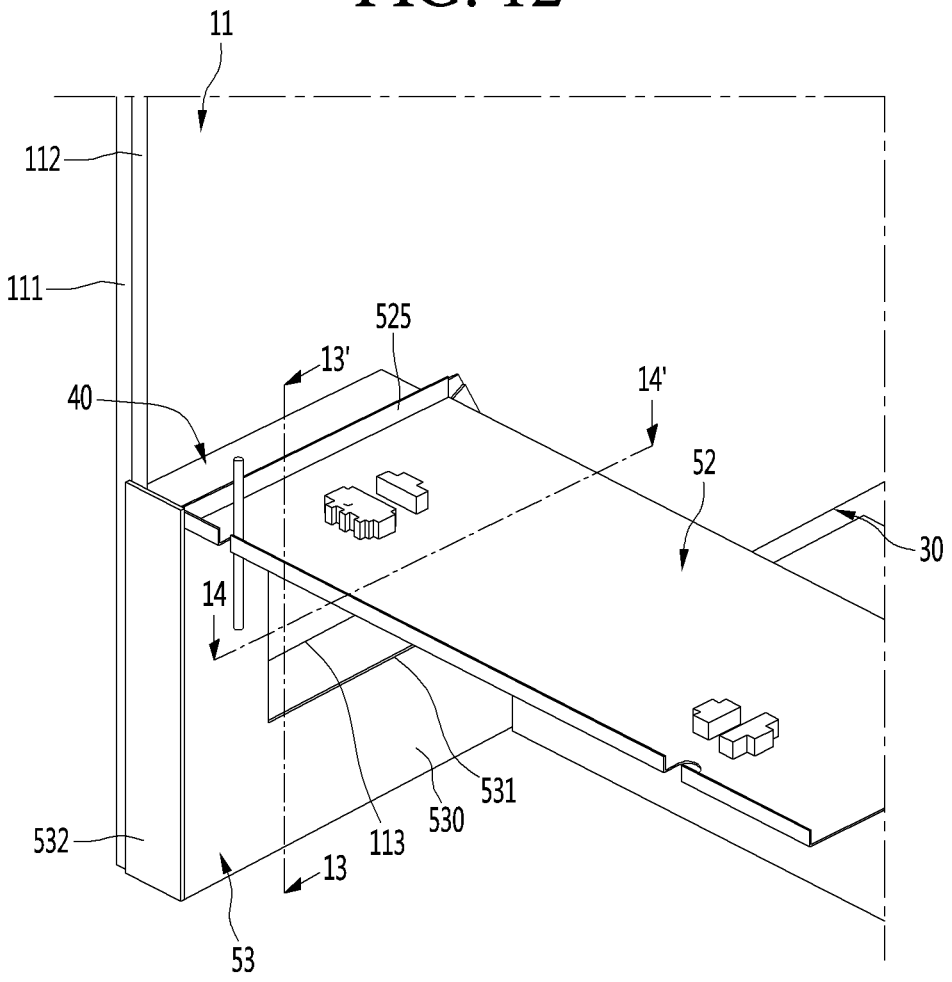
FIG. 12 is a partial perspective view illustrating a mounting state of the machine chamber module.

As illustrated in the drawing, the refrigerator 1 according to an embodiment of the present disclosure may include a cabinet 10 in which storage space is formed, and a door 2 for opening and closing the storage space. A plurality of storage spaces may be provided, and each storage space may be maintained at different storage temperature. For example, as illustrated in FIG. 1, the upper space of the cabinet 10 may be configured as a refrigerating chamber 10*a*, and the lower space may be configured as a freezing chamber 10*b*.

In addition, the cabinet 10 may be configured by an out case (or outer case) 11 forming an outer appearance and an inner case 13 forming storage space inside the refrigerator. Heat insulating material may be filled between the out case 11 and the inner case 13 to insulate the storage space.

The door 2 may include a refrigerating chamber door 2*a* for opening and closing the refrigerating chamber 10*a* and freezing chamber doors 2*b* and 2*c* for opening and closing the freezing chamber 10*b*. The refrigerating chamber door 2*a* may be configured to open and close the refrigerating chamber 10*a* by rotation, and the freezing chamber doors 2*b* and 2*c* may be configured to open and close by drawing in and out of the freezing chamber 10*b* in a drawer type. In addition, a plurality of freezing chamber doors 2*b* and 2*c* may be provided.

Of course, the embodiment of the present disclosure has been described as an example of one of the various types of refrigerators, and the present disclosure is not limited to the shape and the type of refrigerators and will be applicable to all refrigerators equipped with a machine chamber.

On the other hand, the out case 11 may be formed on both side surfaces in the left and right direction and the upper surface of the cabinet 10, the back panel 12 that forms the rear surface of the cabinet 10 can be coupled to the rear end of the outer case 11. In addition, a machine chamber cover 55 may be disposed below the back panel 12, that is, on lower ends of both side surfaces of the out case 11 to shield the rear surface of the machine chamber 20. At this time, the heat-insulating material may be filled in the remaining area except for the machine chamber 20 under the cabinet 10.

The rear side of the lower end of the cabinet 10 may be provided with a machine chamber 20 which is space independent of the storage space. The machine chamber 20 may provide space in which the configuration, such as the compressor 21 and the condenser 22 constituting the refrigeration cycle can be disposed. In addition, the machine chamber 20 may flow outside air into the machine chamber 20, cool the condenser 22 and the compressor 21, and then discharge the outer air to the outside again by the machine chamber cover 55 formed on the rear surface and side grills 51 formed on both side surfaces of the machine chamber 20 in the left and right direction.

Hereinafter, the structure of the machine chamber 20 will be described in more detail with reference to the accompanying drawings. In addition, hereinafter, a surface in which the machine chamber cover 55 is provided is referred to as a rear surface and a rear side and a surface in which the door 2 is formed is referred to as a front surface and a front side with reference to the cabinet 10 of the refrigerator 1.

As illustrated in the drawing, the machine chamber 20 is opened at the lower rear of the rear surface of the cabinet 10, there are a number of configurations, including the compressor 21, the condenser 22, and the cooling fan 23 is disposed therein, and the machine chamber 20 may be shielded by the machine chamber cover 55.

A compressor 21 and a condenser 22 constituting a refrigeration cycle may be provided at both sides of the inside of the machine chamber 20, and a cooling fan 23 may be provided between the compressor 21 and the condenser 22. In addition, a drain tube 222 for discharging the defrost water generated by the evaporator and a drain pan 221 for collecting the defrost water may be provided inside the machine chamber 20, and a dryer, an expansion device, and the like be connected to the refrigerant pipe P may be provided inside the machine chamber 20.

Cover suction ports 551 and cover discharge ports 552 may be formed at both sides of the machine chamber cover 55 in the left and right direction, respectively, and the cover suction port 551 and the cover discharge port 552 may be disposed at a position corresponding to the position of the condenser 22 and the compressor.

Accordingly, when the cooling fan 23 is driven, external air flowing into the cover suction port 551 may cool the condenser 22 while passing through the condenser 22, be blown to the compressor 21 side, cool compressor 21, and then be discharged to the outside through the cover discharge port 552.

Meanwhile, side grills 51 may be provided at both sides of the out case 11 corresponding to both side surfaces of the machine chamber 20 in the left and right direction. The side grille 51 on one side corresponding to the condenser 22 may guide outside air to flow into the machine chamber 20, and the side grille 51 on the side corresponding to the compressor 21 may guide the air inside the machine chamber 20 to be discharged to the outside.

Of course, the cover suction port 551 and the cover discharge port 552 of the machine chamber cover 55 may be provided together with the side grilles 51, and only any one of the cover suction port 551 and the cover discharge port 552 of the machine chamber cover 55 or the side grill 51 may be provided as necessary.

As illustrated in the drawing, the frame assembly consisting of a combination of the reinforcement frame 30 and the reinforcement bracket 40 is mounted on the lower ends of both side surfaces of the out case 11 in the left and right direction, respectively, and the machine chamber module can be mounted between the frame assemblies on both sides. The frame assembly and the machine chamber module may be coupled to each other, and the machine chamber 20 may be fixedly mounted inside the out case 11.

The machine chamber module may include a main plate 52 which forms the wall surfaces of the upper surface and the front surface of the machine chamber 20 and a side cover 53 which is coupled to both side ends of the main plate 52 in the left and right direction and forms both side surfaces of the inside of the machine chamber 20 in the left and right direction. The machine chamber module may be mounted to the out case 11 and the frame assembly in an assembled state.

In addition, the lower surface of the machine chamber 20 may be configured by the base 54. The base 54 may be formed in a plate shape so as to support the compressor 21 and the condenser 22 provided in the machine chamber 20. In addition, the base 54 may be combined with lower ends of the main plate 52 and the side cover 53.

The base 54 may be included in one configuration of the machine chamber module together with the main plate 52 and the side cover 53. In other words, the base 54 may be coupled to the out case 11 and the frame assembly in a state of being coupled with the main plate 52 and the side cover 53.

After the frame assembly is mounted on the out case 11, the machine chamber module is mounted, and the machine chamber cover 55 is mounted while the machine chamber module is mounted to complete the assembly of the machine chamber 20.

The frame assembly may be provided in the same structure on both sides of the out case 11, so as to maintain the strength of both side surfaces at which the machine chamber 20 is located. To this end, the reinforcement frame 30 and the reinforcement bracket 40 may be formed of a metal or alloy material such as steel. In addition, the frame assembly may include a reinforcement frame 30 coupled to the lower ends of both side surfaces and the rear end of both side surfaces of the out case 11, and a reinforcement bracket 40 connected to the reinforcement frame 30.

In detail, the reinforcement frame 30 may include a horizontal portion or frame 31 mounted at a lower end of both side surface of the out case 11 and a vertical portion or frame 32 mounted at the rear end of both side surface of the out case 11. End portions of the horizontal portion 31 and the vertical portion 32 are connected to each other, and thus the horizontal portion 31 and the vertical portion 32 may be located at positions corresponding to edges of the lower end of rear side of the out case 11.

At this time, the length of the horizontal portion 31 may be formed longer than the length of the machine chamber 20. The length of the horizontal portion 31 may be formed to correspond to the length of both side surfaces of the out case 11. In addition, the length of the horizontal portion 31 may be formed to correspond to the length of both side surfaces of the main plate 52 and may simultaneously support the main plate 52 and the out case 11.

In addition, the vertical portion 32 may correspond to or may be slightly higher than the height of the machine chamber 20. Therefore, it is possible to maintain the strength of the side surface of the reinforcement of the machine chamber 20 and the out case 11 in which the machine chamber 20 is disposed. The vertical portion 32 may extend to protrude equal to or more than an upper end of the machine chamber cover 55.

Both the horizontal portion 31 and the vertical portion 32 may be seated on the inner surface of the bent case bent portion (or outer case lip) 112 at the rear end and the lower end of the out case 11 and are coupled by various common senses such as the coupling or riveting of a coupling member such as a screw, caulking, welding, and the like.

On the other hand, the case bent portion 112 can be formed with a slide groove 111 which is recessed inward and to which the cover insertion portions (or slide tabs) 533 and 535 formed at the end portion of the side cover 53 can be slidably inserted when the machine chamber module is mounted. The slide groove 111 may be formed by bending the case bent portion 112 a plurality of times. The case bent portion 112 and the slide groove 111 may be formed along at least the lower ends and the rear ends of both side surfaces of the out case 11 on which the machine chamber 20 is mounted.

In addition, the reinforcement bracket 40 may form a rectangular bracket opening 41 in a state of being mounted on the reinforcement frame 30. At this time, the reinforcement bracket 40 has a structure connecting the horizontal portion 31 and the vertical portion 32, the bracket opening 41 is located inside the reinforcement bracket 40. The bracket opening 41 may communicate with the cover opening 531 of the side cover 53 and the side grill 51. Therefore, the air entering and exiting through the side grill 51 can pass through the bracket opening 41 and the cover opening 531 in order.

Hereinafter, the structure of the side grill 51 and the mounting structure of the side grill 51 will be described in more detail with reference to the accompanying drawings. As illustrated in the drawing, the side grilles 51 may be mounted to case openings 113 formed at lower ends of both side surfaces of the out case 11 corresponding to the side surfaces of the machine chamber 20. The side grilles 51 may be formed in a corresponding shape so as to shield the case opening 113.

For example, the side grilles 51 may be formed in a rectangular shape and may have a size that may be located in an inner region of the side surface of the machine chamber 20. In other words, the side grill 51 may be formed to be equal or somewhat smaller than the size of the cover opening 531 and the bracket opening 41.

The side grill 51 may include a grill body 511 and a grill rim 515 as a whole. The grill body 511 forms an opening that becomes a flow passage of air. The openings inside the grill body 511 are formed with a plurality of horizontal ribs 512 and vertical ribs 513 disposed to intersect each other at predetermined intervals, and air may enter and exit the air flow passage that is formed between the horizontal ribs 512 and the vertical ribs 513. The horizontal ribs 512 and the vertical ribs 513 may have a predetermined inclination, and the air entering and exiting the inside and outside of the machine chamber 20 may have directionality.

In addition, the grill restraint portion 514 may protrude from the outer surface of the grill body 511. The grill restraint unit 514 may be formed on all the top and bottom surfaces and both side surfaces of the grill body 511 in the left and right direction, and a plurality of grill restraint portions 514 may be disposed on each surface to be spaced apart from each other.

An inclined surface **514*a* may be formed on an outer surface of the grill restraint portion 514, and the side grill 51 may be in contact with the end portion of the case opening 113 and the insertion of the grill 51 can be guided when the side grill 51 is inserted into the case opening 113. The grill restraint portion 514 may be formed so as to be elastically deformable and the mounting of the side grill 51** may be more easily performed.

An end portion of the grill restraint portion 514 may be spaced apart from the grill rim 515, and an end portion of the case opening 113 can be inserted into the space between the end portion of the grill restraint portion 514 and the grill rim 515 so that the side grill 51 can be fixedly mounted on the outer case 11.

The grill rim 515 may be formed along an end portion of the grill body 511 and may extend outward by a predetermined width. The grill body 511 may be formed to be somewhat smaller than the size of the case opening 113, and the grill rim 515 may be formed larger than the size of the case opening 113. Therefore, the grill body 511 may form a flow passage of air inside the case opening 113, and the grill rim 515 is in contact with the outer surface of the out case 11 so that the side grille 51 can be mounted.

Referring to FIGS. 8, 9 and 12 to 14, the frame assembly may be composed of a combination of the reinforcement frame 30 and the reinforcement bracket 40. The reinforcement bracket 40 may be mounted to be connected to the horizontal portion 31 and the vertical portion 32, respectively, and may be disposed along the side circumference of the machine chamber 20 in a state of being coupled with the reinforcement frame 30 so that the strength of the side region of the machine chamber 20 can be reinforced.

Meanwhile, the frame assembly may be formed of a high strength metal material, and the plate-like material may be formed by bending a number of times. At this time, the frame assembly may be formed by bending one metal plate to form the horizontal portion 31 and the vertical portion 32. In addition, the horizontal portion 31 and the vertical portion 32 may be joined to each other by welding, caulking, riveting, or the like on one side where the horizontal portion 31 overlaps each other, thereby being capable of maintaining the disposition structure of the horizontal portion 31 and the vertical portion 32. The horizontal portion 31 and the vertical portion 32 may be connected to each other after being formed separately from each other. The horizontal portion 31 may extend along lower ends of both side surfaces of the out case 11. The horizontal portion 31 may extend from the rear end of the machine chamber 20 and may extend toward at least the front of the machine chamber 20.

The horizontal portion 31 may include a horizontal support portion or plate 311, a horizontal reinforcement portion or plate 313, and a horizontal stepped portion or step 312 connecting the horizontal support portion 311 and the horizontal reinforcement portion 313. The horizontal portion 31 may be continuously bent to allow the horizontal support portion 311, the horizontal reinforcement portion 313, and the horizontal stepped portion 312 to be formed of a single member.

In detail, the horizontal support portion 311 may be seated on the upper surface of the case bent portion 112 bent at the lower end of both side surfaces of the out case 11. The horizontal support portion 311 may be formed to have a surface parallel to the case bent portion 112 so as to be in surface contact with the case bent portion 112.

At this time, the horizontal support portion 311 provides a surface on which the lower surface of the reinforcement bracket 40 may be seated. Accordingly, the horizontal support portion 311 may be formed in parallel with both the case bent portion 112 of the lower surface of the out case 11 and the lower surface of the reinforcement bracket 40.

In addition, the horizontal reinforcement portion 313 may be in contact with the inner surface of the lower end of both side surfaces of the out case 11. Therefore, it is possible to support the impact or load applied in the transverse direction on one side of the out case 11 corresponding to the machine chamber 20 so that the cabinet 10 can maintain the set intensity in the area where the horizontal reinforcement portion 313 is disposed.

Figure 13:
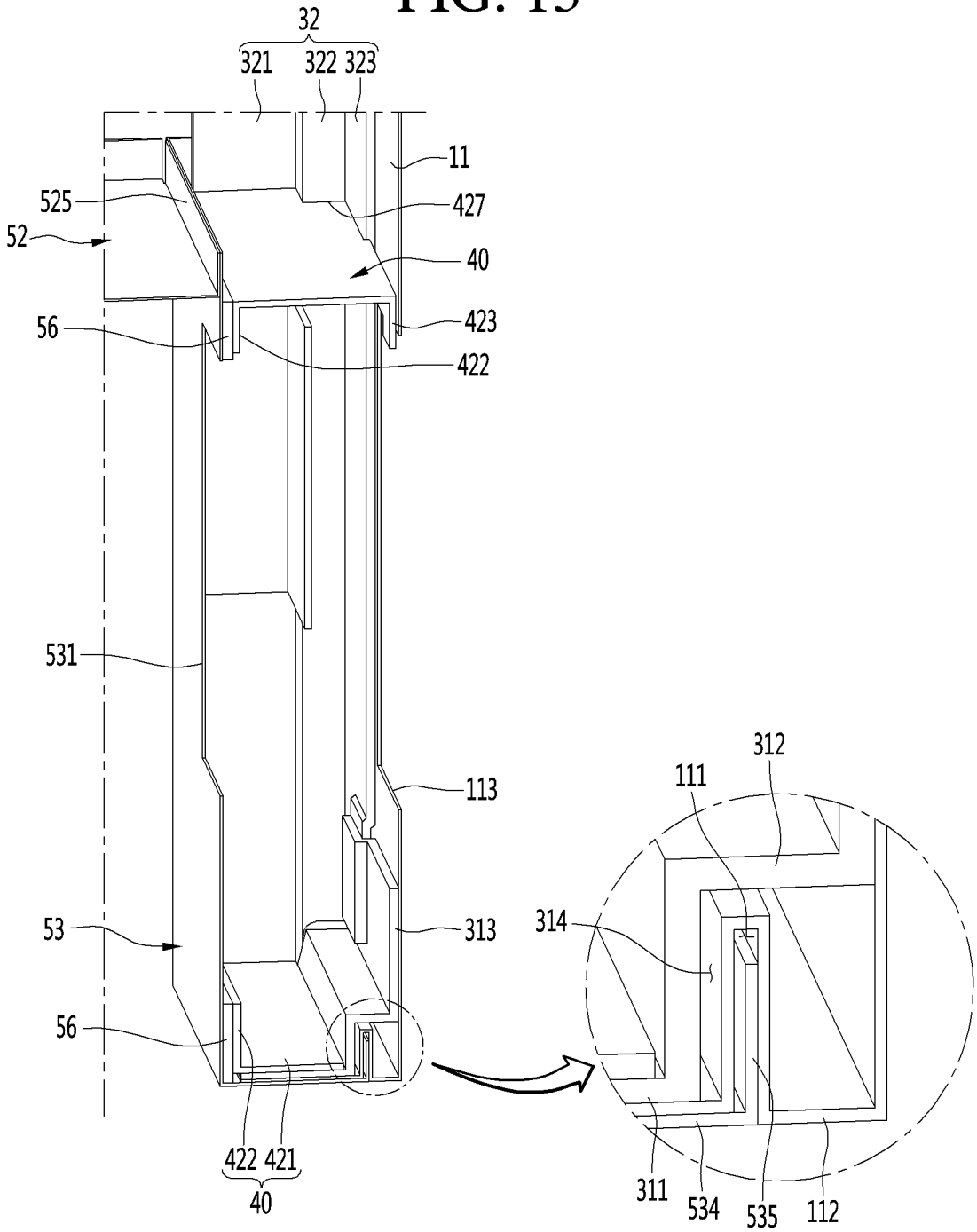
FIG. 13 is a cutaway perspective view taken along line 13-13' of FIG. 12.

The horizontal stepped portion 312 is formed to connect an outer end of the horizontal support portion 311 and a lower end of the horizontal reinforcement portion 313. The horizontal stepped portion 312 may be continuously bent to extend upward from the outer end of the horizontal support portion 311 and then to the outside again. The horizontal stepped portion 312 may be formed perpendicular to the horizontal support portion 311 and the horizontal reinforcement portion 313. Accordingly, when the horizontal portion 31 is mounted at the lower end of the out case 11, a horizontal space portion may be formed between the horizontal stepped portion 312 and the out case 11 as illustrated in FIG. 13. The horizontal space portion 314 provides space in which the slide groove 111 recessed in the case bent portion 112 of the out case 11 can be located.

Meanwhile, the vertical portion 32 may include a vertical support portion or plate 321 and a vertical reinforcement portion or plate 323, and a vertical stepped portion or step 322 connecting between the vertical support portion 321 and the vertical reinforcement portion 323. The vertical portion 32 may be continuously bent to allow the vertical support portion 321, the vertical reinforcement portion 323, and the vertical stepped portion 322 to be formed of a single member.

In detail, the vertical support portion 321 may be seated on the inner surface of the case bent portion 112 bent at the rear ends of both side surfaces of the out case 11. The vertical support portion 321 may be formed to have a surface parallel to the case bent portion 112 to be in surface contact with the case bent portion 112.

At this time, the vertical support portion 321 provides a surface on which the front surface of the reinforcement bracket 40 may be seated. Accordingly, the vertical support portion 321 may be formed in parallel with the front surface of the case bent portion 112 and the reinforcement bracket 40 at the rear end of the out case 11.

The vertical reinforcement portion 323 may be in contact with inner surfaces of rear ends of both side surfaces of the out case 11. Therefore, the vertical reinforcement portion 323 can support the impact or load applied in the transverse direction from one side of the out case 11 corresponding to the machine chamber 20 so that the cabinet 10 can maintain the strength in a region where the vertical reinforcement portion 323 is disposed.

Figure 14:
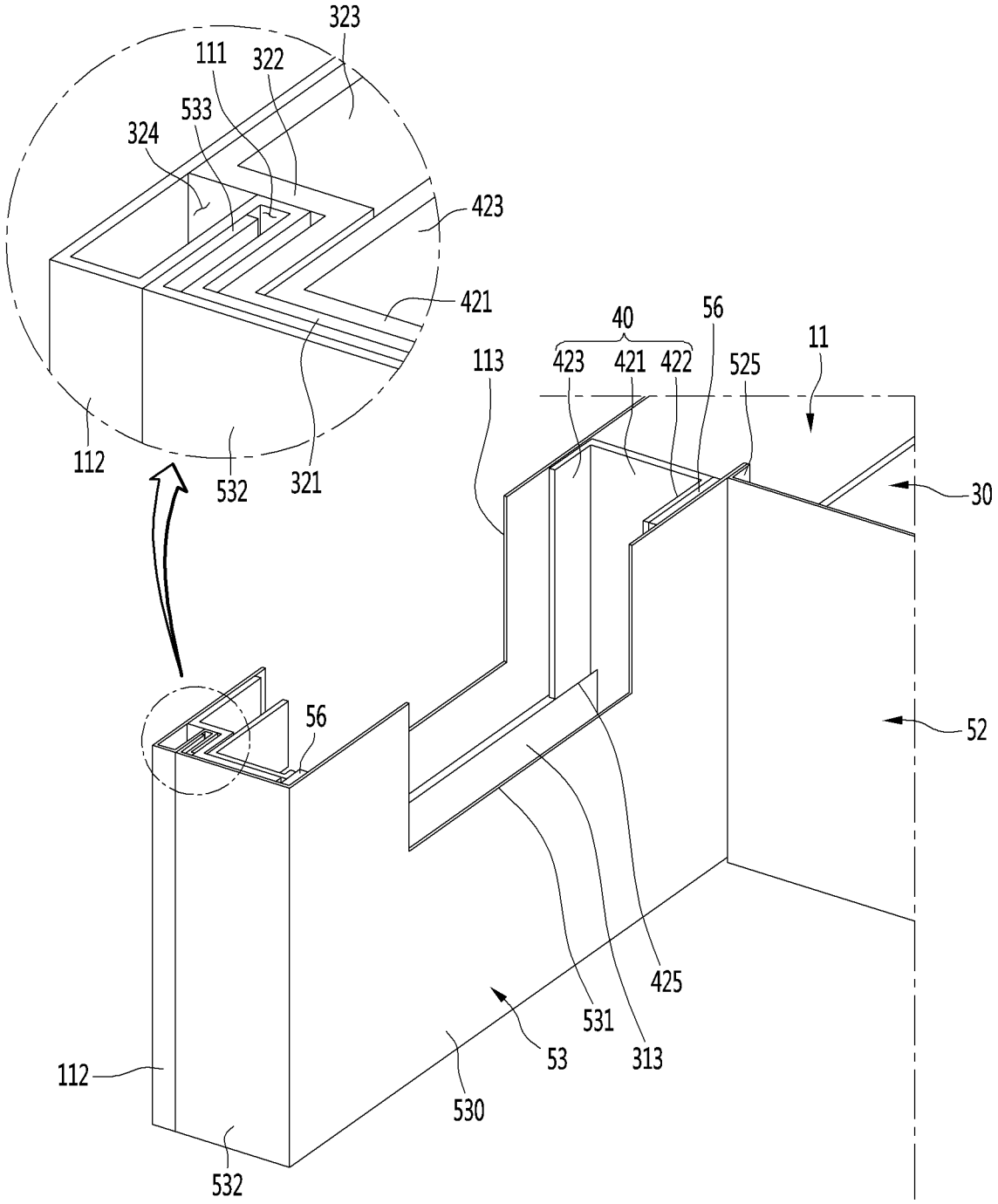
FIG. 14 is a cutaway perspective view taken along line 14-14' of FIG. 12.

The vertical stepped portion 322 is formed to connect the outer end of the vertical support portion 321 and the front end of the vertical reinforcement portion 323. The vertical stepped portion 322 may be continuously bent to extend rearward from the outer end of the vertical support portion 321 and then to the outside again. The vertical stepped portion 322 may be formed to be perpendicular to the vertical support portion 321 and the vertical reinforcement portion 323. Therefore, when the vertical portion 32 is mounted at the rear end of the out case 11, the vertical space portion 324 can be formed between the vertical stepped portion 322 and the out case 11 as illustrated in FIG. 14. The vertical space portion 324 provides a space in which the slide groove 111 recessed in the case bent portion 112 of the out case 11 can be located.

Meanwhile, the reinforcement bracket 40 may reinforce the side strength of the machine chamber 20 and the strength of the lower side of the side surface of the cabinet 10 and the structure connecting the horizontal portion 31 and the vertical portion 32 may be formed. The reinforcement bracket 40 may be formed at a position corresponding to the side surface of the machine chamber 20 and may be disposed along a side circumference of the machine chamber 20.

The reinforcement bracket 40 may correspond to or may be somewhat larger than the size of the side region of the machine chamber 20. Therefore, it may be possible to reinforce the side portion of the machine chamber 20 which is not filled with the heat-insulating material and is connected to the horizontal portion 31 and the vertical portion 32 of the reinforcement frame 30 so that the side surface of the machine chamber 20 may be reinforced more effectively.

The reinforcement bracket 40 may be formed by bending a plate-shaped metal material and may be formed in a shape corresponding to the side surface of the machine chamber 20 or the side cover 53 as a whole. In addition, the bracket opening 41 may be formed at the center of the reinforcement bracket 40. The side grilles 51 may be disposed in an inner region of the bracket opening 41, and the air passing through the side grills 51 may be entered and exited.

The overall shape of the reinforcement bracket 40 may be configured with a first part (or bottom bracket) 401 forming the bottom surface, a second part (or front bracket) 402 forming one side surface, a third part (or inclined bracket) 403 inclined at the second part 402, a third part (or top bracket) 404 parallel to the first part 401, and a fifth part (or rear bracket) 405 forming another side surface at a position facing the second part 402, with respect to the bent portion.

The first to fifth parts 401, 402, 403, 404, and 405 may be formed in a shape that is continuously bent in order, and the overall shape may be formed to correspond to the side shape of the machine chamber 20. The reinforcement bracket 40 may be disposed on the side of the side cover 53 and may have a corresponding size.

The first part 401 may be positioned at a position corresponding to and may have a corresponding length to a lower end of the side cover 53, the second part 402 may be positioned at a position corresponding to and may have a corresponding length to a front end of the side cover 53, the third part 403 may be positioned at a position corresponding to and may have a corresponding length to an inclined portion of the side cover 53, the forth part 404 may be positioned at a position corresponding to and may have a corresponding length to an upper end of the side cover 53, and the fifth part 405 may be positioned at a position corresponding to and may have a corresponding length to a rear end of the side cover 53. At this time, the length of the fifth part 405 may be slightly shorter than the front end of the side cover 53, so that the lower end of the fifth part 405 and the front end of the first part 401 are spaced apart from each other and thus a space 43 may be formed.

End portions of the first part 401 and the fifth part 405 may be spaced apart from each other, and thus, it may be possible to form the reinforcement bracket 40 by bending one sheet plate material in turn. Of course, the reinforcement bracket 40 may be formed in at least two or more parts and then may be coupled to each other, and the entirety thereof may be formed in a forming method such as injection rather than bending, and at this time, a shape such that the first part 401 and the fifth part 405 are connected to each other may be provided.

In particular, the first part 401 may be fixed to the horizontal support portion 311, and the fifth part 405 may be fixed to the vertical support portion 321. Accordingly, the horizontal support portion 311 and the vertical support portion 321 may have a structure connected to each other by the reinforcement bracket 40, and both side surfaces of the out case 11 in which the machine chamber 20 is located may be further reinforced.

The reinforcement bracket 40 may be formed of a metal material or a composite material having high strength and the reinforcement bracket 40 may include a center part (or center plate) 421 forming an overall shape, and a first side part or plate 422 and a second side part or plate 423 bent at both side surfaces of the center part 421. In detail, the center part 421 may be formed in a planar shape providing a surface in contact with the horizontal support portion 311 and the vertical support portion 321 and may be bent continuously so as to form the first to fifth parts 401, 402, 403, 404, and 405. The width of the center part 421 may be greater than or equal to the width of the horizontal support portion 311 and the vertical support portion 321. The width of the center part 421 may be smaller than that of the cover rear part (or rear cover) 532 or the cover lower part or plate 534 of the side cover 53 such that the reinforcement bracket 40 may have a shape which is received inward of the side cover 53.

Meanwhile, a recessed horizontal seating portion 424 may be formed at a position corresponding to the lower end of the second part 402 of the center part 421. The horizontal seating portion 424 may be formed to contact the horizontal stepped portion 312 when the reinforcement bracket 40 is mounted to the reinforcement frame 30. In other words, the horizontal seating portion 424 is recessed to correspond to the protruding shape of the horizontal stepped portion 312, and thus the horizontal stepped portion 312 and the horizontal seating portion 424 may be configured to be in close contact with each other.

In addition, as illustrated in FIG. 13, a recessed vertical seating portion 427 may be formed at a position corresponding to the front end of the fourth part 404 of the center part 421. The vertical seating portion 427 may be formed to contact the vertical stepped portion 323 when the reinforcement bracket 40 is mounted to the reinforcement frame 30. In other words, the vertical seating portion 427 is recessed to correspond to the protruding shape of the vertical stepped portion 323, and thus the vertical stepped portion 323 and the vertical seating portion 427 may be configured to be in close contact with each other.

The reinforcement frame 30 and the reinforcement bracket 40 may be further in close contact with each other by the structure of the horizontal seating portion 424 and the vertical seating portion 427. As a result, the impact and load transmitted from the outside can be more effectively distributed, and thus the side reinforcement performance of the machine chamber can be significantly improved.

Meanwhile, a first side part 422 may be formed at one side end of both side ends of the center part 421 facing the machine chamber 20. The first side part 422 may be bent vertically from the center part 421 and may have a predetermined width. Therefore, when the side cover 53 is mounted, a surface in contact with the side cover 53 may be provided.

In addition, a bracket mounting portion 426 recessed inward may be formed in the first side part 422 formed at a position corresponding to the fifth part 405 of the first side part 422. The bracket mounting portion 426 may be equipped with an electrical component such as the reactor 24.

A second side part 423 may be formed at one side end of both side ends of the center part 421 toward the out case 11. The second side part 423 may also be bent vertically from the center part 421 and may have a predetermined width. Therefore, the out case 11 may be substantially supported from the inside of the out case 11 in contact with the inner surface of the out case 11. The second side part 423 may be omitted at a position corresponding to the first part 401 of the second side part 423 to prevent interference with the horizontal stepped portion 312.

In addition, a side seating portion 425 may be formed at a lower end of the second side part 423 formed at a position corresponding to the second part 402 of the second side part 423. The side seating portion 425 may be formed to be in contact with the upper end of the horizontal reinforcing portion 313 of the horizontal portion 31. Accordingly, the outer side surface of the second side part 423 may have the same plane as the outer side surface of the horizontal reinforcement portion 313 and have a structure that is in contact with and supports the inside surface of the out case 11 at the same time.

In addition, the second side part 423 formed at a position corresponding to the fifth part 405 of the second side part 423 is configured to be bent in an inner region of the vertical support portion 321, and the vertical step 322 and to be in contact with one side surface of the vertical step 322.

Meanwhile, the plurality of first side parts 422 and second side parts 423 formed in the first to fifth parts 401, 402, 403, 404, and 405, respectively, may be formed to be inclined so that the parts that are bent and are continuously in contact with each other at the time of molding the reinforcement bracket 40 may be in contact with each other. The inclined end portions may be firmly fixed by bonding to each other.

The reinforcement frame 30 and the reinforcement bracket 40 may be disposed on an inside surface of the out case 11 in a state where the reinforcement frame 30 and the reinforcement bracket 40 are coupled to each other. At this time, the reinforcement bracket 40 may be first coupled to the reinforcement frame 30, and then the reinforcement frame 30 may be mounted to the out case 11. In addition, the reinforcement bracket 40 may be coupled to the reinforcement frame 30 in a state where the reinforcement frame 30 is first mounted on the out case 11. The machine chamber module may be mounted to be coupled to the out case 11 and the frame assembly while the frame assembly is mounted to the out case 11.

As illustrated in the drawing, the machine chamber module may include the main plate 52 and the side cover 53. In addition, the machine chamber module may further include the base 54.

The main plate 52 is to form the upper surface and the front surface of the machine chamber 20 and may be formed by bending a plate-shaped metal material. The side cover 53 may be coupled to both side surfaces of the main plate 52 in the left and right direction to form both inner sides of the machine chamber 20 in the left and right direction. The base 54 may be combined with a lower end of the main plate 52 and a lower end of the side cover 53 to form a lower surface of the machine chamber 20.

The machine chamber module in the assembled state may be coupled to a lower end of the out case 11 in which the frame assembly is mounted to form a space of the machine chamber 20. At this time, the base 54 may configure the machine chamber module in a state where the configuration such as the compressor 21, the condenser 22, and the cooling fan 23 are mounted. Of course, if necessary, the base 54, in which the configuration such as the compressor 21, the condenser 22, and the cooling fan 23 are mounted while the machine chamber module is first mounted to the out case 11 may be combined with the machine chamber module to form the machine chamber 20.

The main plate 52 may be formed in a rectangular plate shape, and may be configured with an upper portion 521 forming an upper surface of the machine chamber 20, a rear portion 523 forming a rear surface of the machine chamber 20, and an inclined portion 522 forming a surface inclined between the upper portion 521 and the rear portion 523, and a bottom portion 524 extending rearward from the lower end of the rear portion 523.

The upper portion 521, the inclined portion 522, and the rear portion 523 may form an inner surface of the machine chamber 20, and the bottom portion 524 may form a bottom surface of the cabinet 10. The bottom portion 524 is formed to be wider than the width of the rear portion 523, and both ends may be formed to be coupled to the horizontal portion 31 of the reinforcement frame 30. A cover connection portion (or tab) 526 protruding forward may be formed at the front ends of both side surface of the bottom portion 524 and may be coupled to the cover lower part 534 of the side cover 53.

The upper portion 521 may have a tube hole 521*a* through which the drain tube 222 passes and a guide hole 521*b* on which the fan guide of the cooling fan 23 is mounted. In addition, a connector 521*e* to which electric wires that are connected with the electrical devices and the components received in the machine chamber 20 is connected is mounted on the upper portion 521. In addition, both sides of the upper portion 521 may be further formed with a pipe hole 521*d* through which the refrigerant pipe P introduced into the machine chamber 20 passes. In addition, the rear portion 523 may further include a guide hole 521*c* to which the rear end of the fan guide of the cooling fan 23 is mounted.

On the other hand, the plate coupling portion or lip 525 bent upward along the circumference of the main plate 52 may be formed. The plate coupling portion 525 formed at the rear end of the upper portion 521 may be combined with the upper end of the machine chamber cover 55. The plate coupling portions 525 formed at both side ends of the upper portion 521 in the left and right direction and at both side ends of the inclined portion 522 and the rear portion 523 may be coupled to the circumference of the side cover 53. The plate coupling portions 525 formed at both side ends of the bottom portion 524 may be coupled to the horizontal portion 31 or the out case 11 of the frame assembly.

The side cover 53 may form both side surfaces of the machine chamber 20 in the left and right direction and may be coupled to the main plate 52. The side cover 53 may be formed in a plate shape of a metal material, and the front end and the lower end may be bent to receive the reinforcement frame 30.

In detail, the side cover 53 may include a cover part or plate 530 that forms a substantially both side surfaces inside the machine chamber 20 in the left and right direction, a cover rear part or plate 532 that is bent outward from the rear end of the cover part 530, and the cover lower part 534 that is bent outward from the lower end of the cover part 530.

Some of the outer circumference of the cover part 530 may be combined with the main plate 52 at a corresponding position. The upper and front ends of the cover part 530 may be coupled to each other by being in contact with the plate coupling portion 525 formed on the upper portion 521, the inclined portion 522, and the rear portion 523 of the main plate 52, respectively. Accordingly, the upper end and the front end of the cover part 530 may be formed in a shape corresponding thereto and may be coupled to each other by fastening the plate coupling part 525 with caulking, riveting, welding, or coupling member. The cover opening 531 may be formed at the center of the cover part 530.

The cover rear part 532 and the cover lower part 534 may be bent outward from the rear end and the lower end of the cover part 530, respectively. In addition, a lower end of the cover rear part 532 and a rear end of the cover lower part 534 may be in contact with each other and may be coupled to each other.

The cover rear part 532 may be formed to be larger than the width of the vertical support portion 321 of the reinforcement frame 30 and may form a space such that the vertical support portion 321 is located inside. In other words, at least a portion of the vertical support portion 321 of the reinforcement frame 30 may be shielded by the cover rear part 532.

The cover rear part 532 may be exposed to the rear in a state where the machine chamber module is mounted to the out case 11 and may be coupled to both side ends of the machine chamber cover 55 in the left and right direction. When the machine chamber cover 55 is mounted, the opened rear surface of the machine chamber 20 and also the cover rear parts 532 on both sides can be shielded.

The cover lower part 534 may be formed to be larger than the width of the horizontal support portion 311 of the reinforcement frame 30 and may be configured to receive the horizontal support portion 311 therein. In other words, at least a portion of the horizontal support portion 311 of the reinforcement frame 30 may be shielded by the cover lower part 534.

Meanwhile, cover insertion portions 533 and 535 vertically bent may be formed at the extended end portions of the cover rear part 532 and the cover lower part 534. The cover insertion portions 533 and 535 may be formed to be inserted into the slide groove 111 formed in the case bent portion 112 of the out case 11. Based on such a structure, the machine chamber module may be fixedly mounted to the out case 11 and the reinforcement frame 30 to configure the machine chamber 20.

Hereinafter, the coupling structure of the out case 11, the frame assembly, and the side cover 53 forming both side surfaces of the machine chamber 20 will be described in detail with reference to the drawings. As illustrated in the drawing, the reinforcement frame 30 and the reinforcement bracket 40 may be mounted on the corners of the rear end and the lower end of the out case 11 in a coupled state. In addition, the machine chamber module to which the main plate 52 and the side cover 53 are coupled may be mounted on the out case 11.

In detail, the reinforcement frame 30 may be coupled to the lower end and the rear end of the out case 11, respectively, and the reinforcement bracket 40 may connect the vertical portion 32 and the horizontal portion 31 to reinforce the side of the machine chamber 20 together with the reinforcement frame 30. In addition, the side cover 53 may be mounted with the out case 11 to cover the front and lower surfaces of the reinforcement bracket 40, the reinforcement frame 30 and the reinforcement bracket 40 may be prevented from being exposed to the outside, when the machine chamber cover 55 is opened. In addition, both side covers 53 may be fixed to the out case 11 to support the main plate 52.

The machine chamber module coupled to the side cover 53 and the main plate 52 may be mounted to the out case 11 while being sled-in and inserted while moving from the rear to the front of the out case 11. In detail, the side cover 53 may be disposed on the rear end of both side surfaces of the inner case 13 at the rear of the inner case 13 while the side cover 53 is coupled to both sides of the main plate 52. In addition, the cover insertion portions 533 and 535 of the rear end and the lower end of the side cover 53 may be inserted into the slide groove 111 of the out case 11.

At this time, the front end of the cover insertion portion 535 of the cover lower part 534 is inserted into the slide groove 111 formed at the lower end of the out case 11, the cover insertion portion 535 is further slid by pushing the side cover 53 forward in a state where the cover insertion portion 535 is inserted into the slide groove 111. When the side cover 53 is completely moved forward, the cover insertion portion 533 of the cover rear part 532 may be inserted into the slide groove 111 formed at the rear end of the out case 11.

When the side cover 53 is completely inserted into the out case 11 and fixed, the main plate 52 coupled to the side cover 53 on both sides may be positioned in a correct position. The cover rear part 532 may be positioned on the same surface as the rear end of the out case 11.

The cover rear part 532 of the side cover 53 may be in contact with the vertical portion 32 of the reinforcement frame 30, the cover rear part and the vertical portion may be coupled to each other by fastening or riveting, caulking, welding, or the like of a separate coupling member. Similarly, the cover lower part 534 may be in contact with the horizontal portion 31 of the reinforcement frame 30, may be coupled to each other by fastening or riveting, caulking, welding, or the like of the separate coupling member, and configurations forming the machine chamber 20 can be formed on the cabinet 10.

On the other hand, the inner surface of the side cover 53 may be further provided with a gasket 56 for sealing between the side surface of the reinforcement bracket 40 and the inner surface of the side cover. The gap between the side cover 53 and the reinforcement bracket 40 may be sealed by the gasket 56, and thus the foaming liquid may not leak when the foaming liquid is injected for molding the heat-insulating material. In addition, the gasket 56 may allow the side surface of the reinforcement bracket 40 and the side cover 53 to be bonded to each other.

Since the reinforcement bracket 40 connects the vertical portion 32 and the horizontal portion 31 of the reinforcement frame 30, the reinforcement bracket reinforces the strength of the side surface of the machine chamber 20, and the side surface of the out case 11 and the side cover 53 are supported by the reinforcement bracket 40 to further reinforce the strength of the side surface of the machine chamber 20.

As illustrated in the drawing, in a state where the overall size of the refrigerator 1 remains the same, as the space of the machine chamber 20 is compact, the capacity of the storage space can be increased, and the thickness of the heat-insulating material that surrounds the storage space can be increased to improve the power consumption. In addition, the space of the machine chamber 20 may be configured to have a minimum space disposition in which components including the compressor 21, the condenser 22, and the cooling fan 23 may be received.

However, there may occur a case where the electronic component is additionally mounted as necessary. For example, a reactor 24 may be further mounted on the refrigerator 1 to prevent sudden fluctuations in supply current or initial surge voltage. The reactor 24 may be selectively disposed according to the use environment or the product of the refrigerator 1.

If a separate space is formed on the cabinet 10 for the disposition of the reactor 24, it may cause a loss of the foam insulation space. In addition, when the reactor 24 is to be disposed in the machine chamber 20, interference with other components may occur, and re-disposition of the components inside the machine chamber 20 for mounting the reactor 24 may be required.

Figure 15:
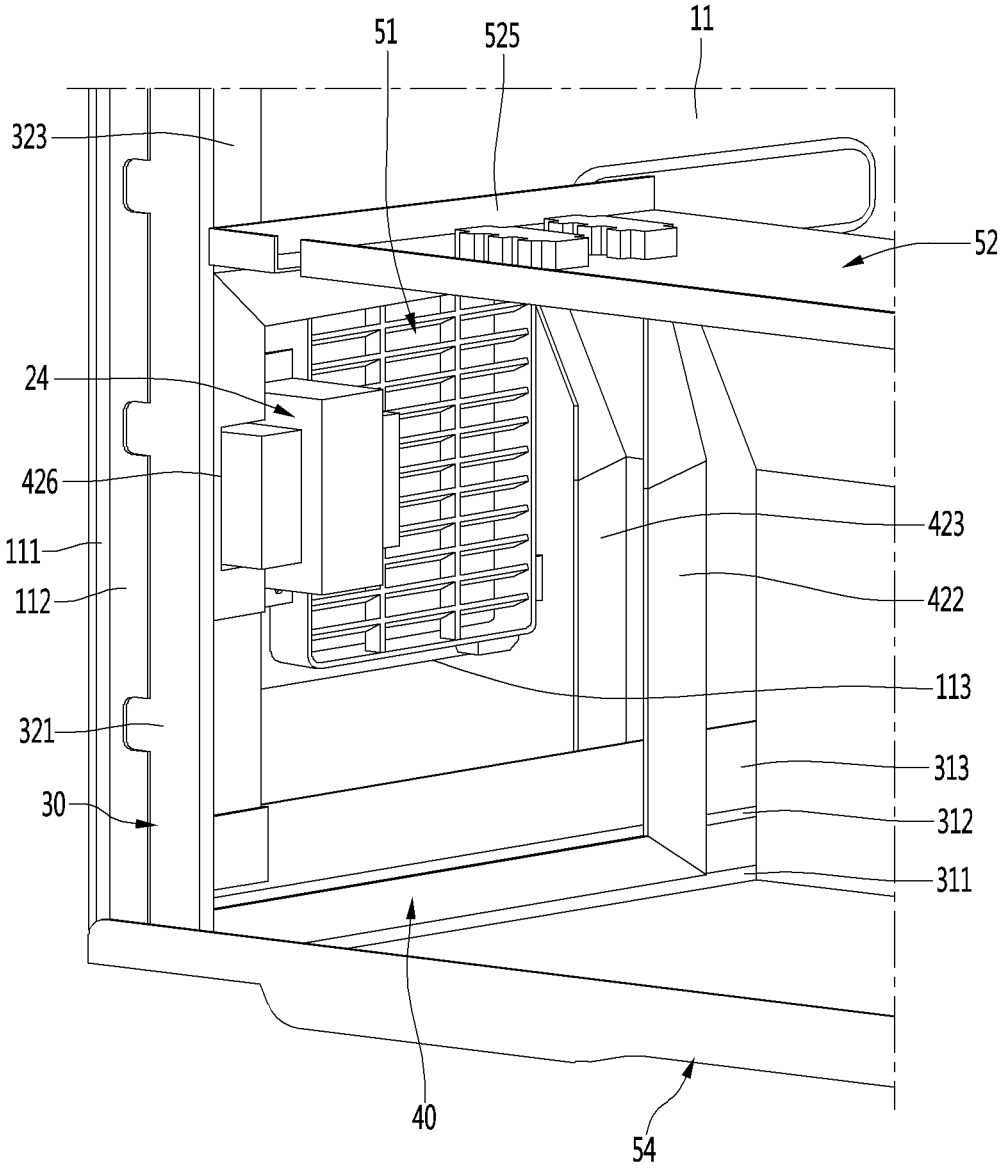
FIG. 15 is a partial perspective view illustrating a state where a reactor is mounted on the frame assembly.
Figure 16:
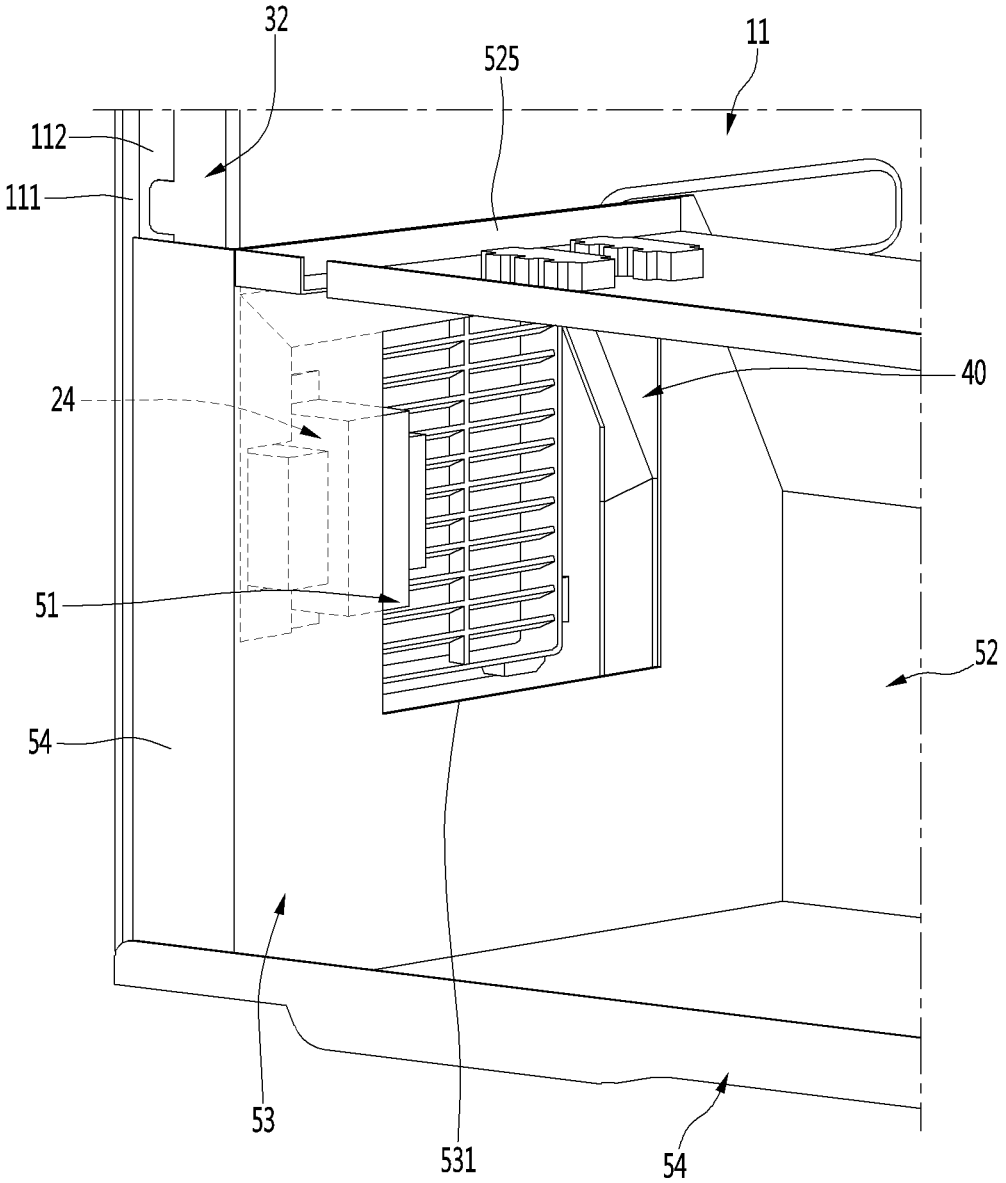
FIG. 16 is a partial perspective view illustrating a state where the side cover is mounted in FIG. 15.

As in FIGS. 15 and 16, however, when the reactor 24 is mounted on the reinforcement bracket 40, a separate structure and space securing for mounting the reactor 24 are not required, and the reactor is disposed in the inner region of the reinforcement bracket 40 disposed in order to reinforce the strength of the machine chamber 20 and the space already secured inside the bracket opening 41, and thus the disposition state of other components inside the machine chamber 20 can be maintained.

To this end, the bracket mounting portion 426 may be formed in the reinforcement bracket 40. The bracket mounting portion 426 may be cut into a shape corresponding to at least a portion of the reactor 24 so that the reactor 24 may be mounted.

Meanwhile, in a state where the reactor 24 is mounted on the bracket mounting portion 426, when the side cover 53 is mounted, the reactor 24 can be at least partially shielded by the side cover 53. Therefore, damage due to the exposure of the reactor 24 can be prevented, and the outer appearance can be made to be viewed to be cleaner. In addition, by disposing the optional electronic components such as the reactor 24 to the inside of the reinforcement bracket 40, the efficiency of the space disposition inside the machine chamber can be improved.

In addition, in a structure in which the side grille 51 is not provided on the side surface of the machine chamber 20, an inner space of the reinforcement bracket 40 may be further secured, and thus, the space in which more electrical components can be disposed can be secured.

Of course, the bracket mounting portion 426 may be equipped with a variety of electrical components that can be additionally mounted other than the reactor 24. Electrical components mounted on the bracket mounting portion 426 may be disposed in the reinforcement bracket 40. Meanwhile, various assembly methods of the refrigerator 1 based on the above-described structure will be described.

As an example of a method of assembling a refrigerator, the reinforcement frame 30 and the reinforcement bracket 40 may be combined into one frame assembly, and then the frame assembly may be mounted to the out case 11. In addition, the machine chamber module coupled to the main plate 52 and the side cover 53 may be fastened to the out case 11 and the frame assembly to form a space of the machine chamber 20. Subsequently, the machine chamber 20 may be completely assembled by mounting the base 54 including the compressor 21, the condenser 22, and the machine chamber cover 55 in order.

As another example, the reinforcement bracket 40 may be fixed to and mounted on the reinforcement frame 30 after the reinforcement frame 30 is first mounted on the out case 11. In addition, the machine chamber module coupled to the main plate 52 and the side cover 53 may be fastened to the out case 11 and the frame assembly to form a space of the machine chamber 20. Subsequently, the machine chamber 20 may be completely assembled by mounting the base 54 including the compressor 21, the condenser 22, and the like and the machine chamber cover 55 in order.

As an example of another method, the reinforcement frame 30 may be first mounted on the out case 11. In addition, in a state where the reinforcement bracket 40 and the side cover 53 are coupled to each other, the reinforcement bracket 40 and the side cover 53 coupled to each other may be assembled to be coupled to the reinforcement frame 30 and the out case 11. Next, the main plate 52 may be coupled to the side covers 53 on both sides thereof to form space of the machine chamber 20. Subsequently, the machine chamber 20 may be completely assembled by mounting the base 54 including the compressor 21, the condenser 22, and the like and the machine chamber cover 55 in order.

Meanwhile, in a state where the machine chamber is completely assembled, the state where the machine chamber is fixed will be described with reference to the drawings.

Figure 17:
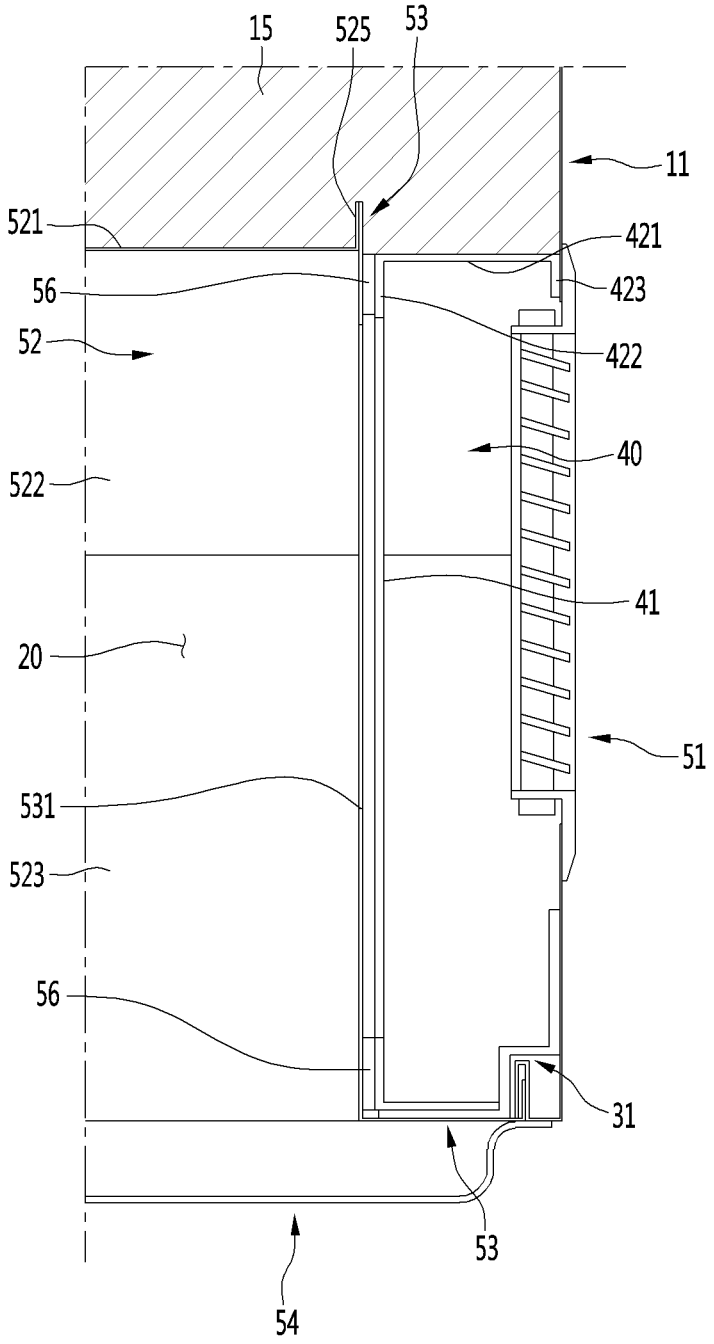
FIG. 17 is a cross-section view of a joint between the main plate and the side cover of the machine chamber module.
Figure 18:
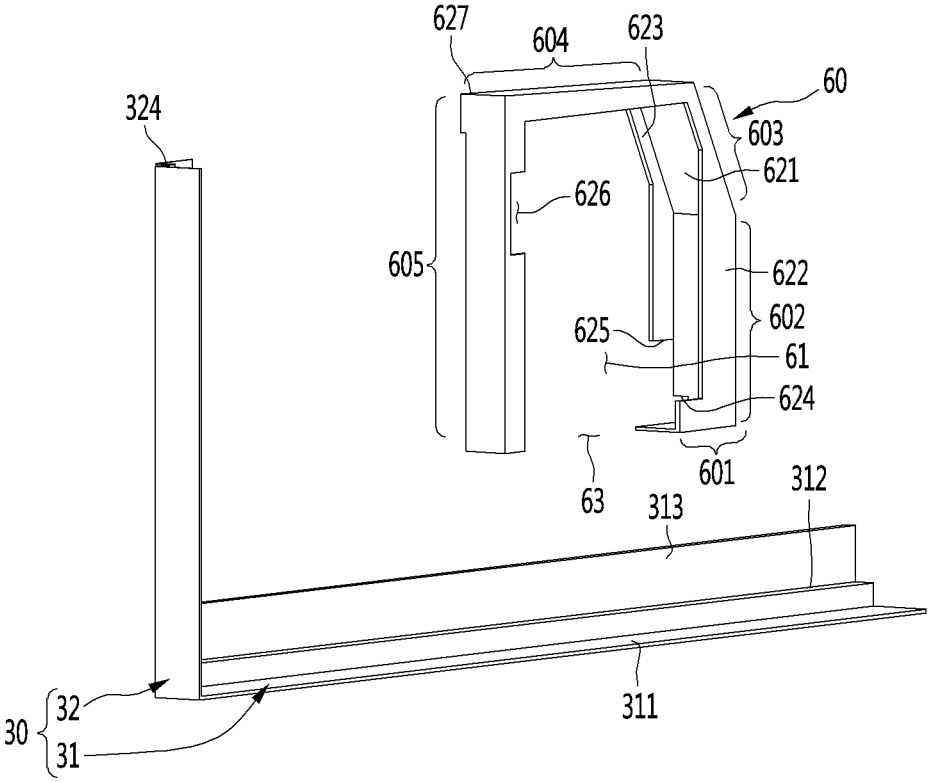
FIG. 18 is an exploded perspective view illustrating a coupling structure of a frame assembly according to another embodiment of the present disclosure viewed from one side.
Figure 19:
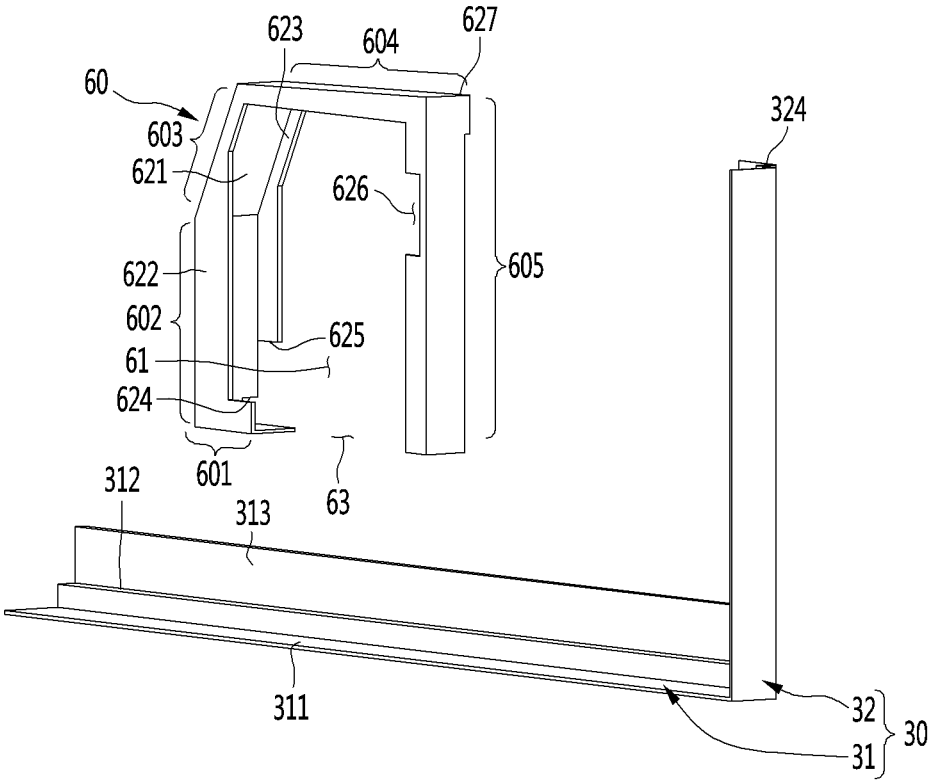
FIG. 19 is an exploded perspective view illustrating the coupling structure of the frame assembly viewed from the other side.
Figure 20:
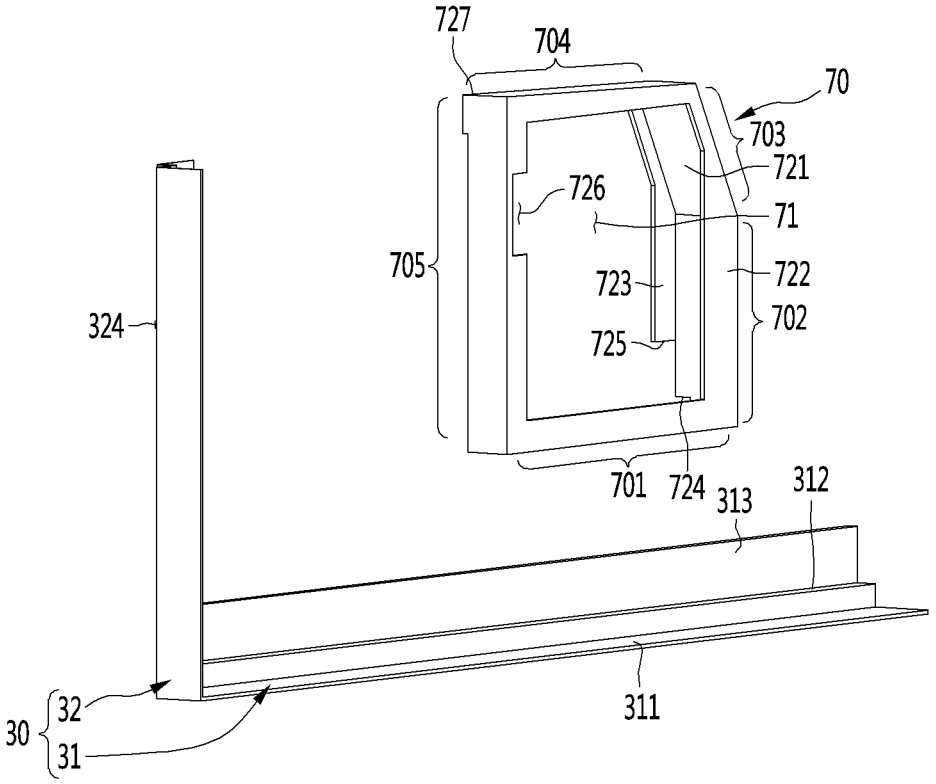
FIG. 20 is an exploded perspective view illustrating an upper portion of a refrigerator door of a coupling structure of a frame assembly according to another embodiment of the present disclosure.
Figure 21:
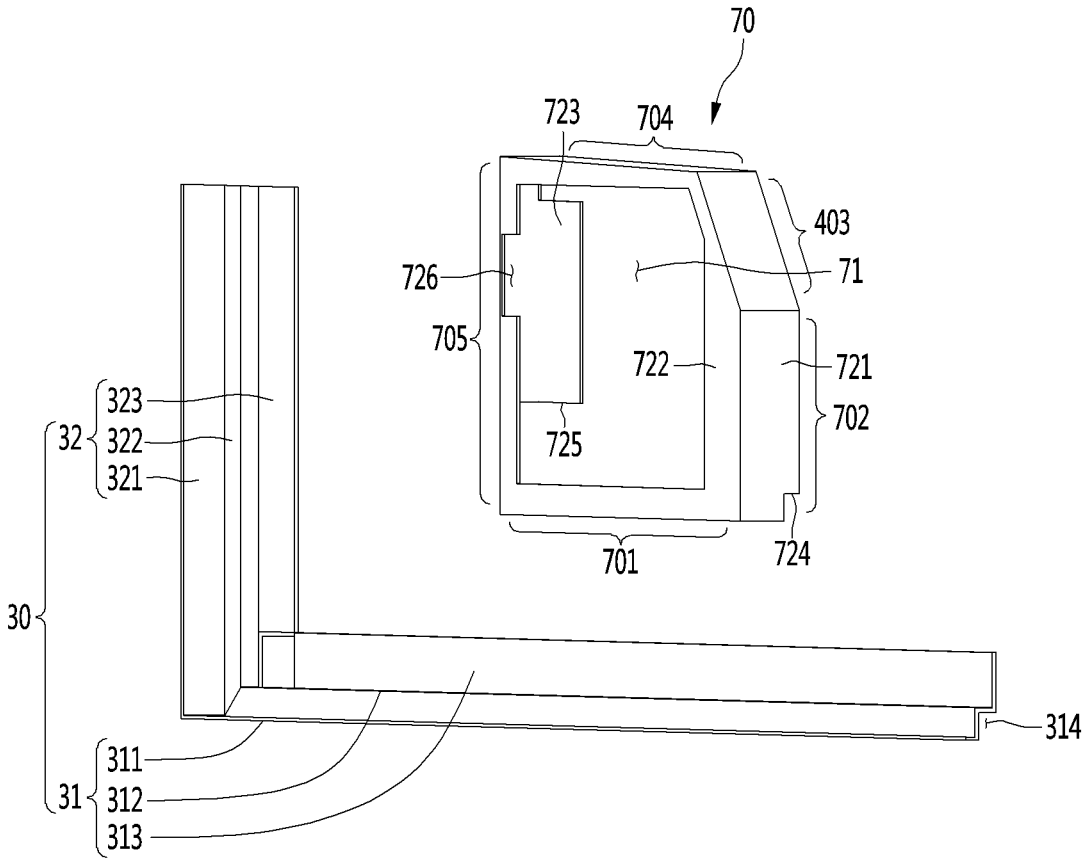
FIG. 21 is an exploded perspective view illustrating the coupling structure of the frame assembly viewed from the other side.

FIG. 17 is a partial cross-sectional view illustrating a state where the machine chamber is assembled.

As illustrated in the drawing, in a state where the machine chamber 20 is assembled, the machine chamber 20 is fixedly mounted on the reinforcement frame 30 and the reinforcement bracket 40 on the inner surface of the out case 11. The out case 11 may be supported by the reinforcement frame 30 and the reinforcement bracket 40. In addition, the other side surface of the reinforcement bracket 40 supports a side end of a case of the machine chamber.

At this time, if the case of the machine chamber includes the main plate 52 and the side cover 53, the reinforcement bracket 40 may support the side surface of the side cover 53. Of course, if the case of the machine chamber is composed of the main plate 52 in a state where the side cover 53 is omitted, the reinforcement bracket 40 may be a structure in which the frame assembly and the case of the machine chamber case are coupled by being in contact with the side end of the main plate 52.

In addition, the gasket 56 is disposed between the case of the machine chamber and the reinforcement bracket 40, and thus, if foaming liquid is injected to form the heat insulating material 15 inside the cabinet 10, it is possible to prevent the foaming liquid from flowing between the case of the machine chamber case and the reinforcement frame 30.

Meanwhile, in a state where the machine chamber 20 is assembled, the space where the heat insulating material 15 is formed and the region of the machine chamber 20 including both sides of the machine chamber 20 may be completely separated. Therefore, even if the heat insulating material 15 is formed by injection of the foaming liquid, the heat insulating material 15 fills only the outer region of the machine chamber 20.

In detail, as illustrated in FIG. 17, the heat insulating material 15 is in contact with the outer surface of the machine chamber case, the outer surface of the reinforcement bracket 40, and the inner surface of the out case 11 at the same time. Therefore, in a process of forming the heat insulating material 15 by injecting a foaming liquid, the upper surface and the front surface of the machine chamber 20, the center part 421 of the reinforcement bracket 40, and the inner surface of the out case 11 may be in contact with and fixed to the heat insulating material 15 at the same time. Therefore, the reinforcement bracket 40 may be completely fixed, and the case of the machine chamber, the reinforcement bracket 40, and the out case 11 can be fixed integrally via the heat insulating material 15, and thus each configuration cannot slip or flow.

Particularly, even if a load or an impact is applied toward the machine chamber 20, the reinforcement bracket 40 does not slip or flow and maintains a firmly fixed state by the foamed heat insulating material 15 to further reinforce the machine chamber 20.

In addition, the plate coupling portion 525 protrudes toward the heat insulating material, so that when the heat insulating material 15 is foamed, due to the heat insulating material, the main plate 52 and the reinforcement bracket 40 cannot flow more transversely and the strength of the traverse direction of the machine chamber 20 can be reinforced.

As an example of another method, the reinforcement frame 30 may be first mounted on the out case 11. Next, the reinforcement bracket 40 may be mounted on the reinforcement frame 30. Subsequently, the side cover 53 may be coupled to the reinforcement bracket 40 and the out case 11, and then the main plate 52 may be coupled to the side cover 53 on both sides to form the space of machine chamber 20. Subsequently, the machine chamber 20 may be completely assembled by mounting the base 54 including the compressor 21, the condenser 22, and the like and the machine chamber cover 55 in order.

Meanwhile, the present disclosure may encompass various other embodiments in addition to the above-described embodiment. Other embodiments of the present disclosure may be different only in the structure of the reinforcement bracket 40, all other configurations may be the same, the same reference numerals are used for the same configuration and the detailed description thereof will be omitted.

Hereinafter, other embodiments of the present disclosure will be described in detail with reference to the accompanying drawings. As illustrated in the drawing, the frame assembly according to another embodiment of the present disclosure may be composed of a combination of the reinforcement frame 30 and the reinforcement bracket 60. The reinforcement frame 30 may include the horizontal portion 31 and the vertical portion 32, and the structure thereof may be the same as the above-described embodiment. The reinforcement bracket 60 may be mounted to be connected to the horizontal portion 31 and the vertical portion 32, respectively, and may be disposed along the side circumference of the machine chamber 20 in a state of being coupled with the reinforcement frame 30 and the strength of the side region of the machine chamber 20 can be reinforced.

The reinforcement bracket 60 may be formed at a position corresponding to the side surface of the machine chamber 20 and may be disposed along a side circumference of the machine chamber 20. The reinforcement bracket 60 may be formed to correspond to or may be somewhat larger than the size of the side region of the machine chamber 20. Therefore, it may be possible to reinforce the side portion of the machine chamber 20 which is not filled with the heat-insulating material and is connected to the horizontal portion 31 and the vertical portion 32 of the reinforcement frame 30 so that the side surface of the machine chamber 20 can be reinforced more effectively.

The reinforcement bracket 60 may be formed by bending a plate-shaped metal material and may be formed in a shape corresponding to the side surface of the machine chamber 20 or the side cover 53 as a whole. In addition, the bracket opening 61 may be formed at the center of the reinforcement bracket 60. The side grilles 51 may be disposed in an inner region of the bracket opening 61, and the air passing through the side grills 51 may be entered and exited.

The overall shape of the reinforcement bracket 60 may be configured with a first part (or bottom plate) 601 forming the bottom surface, a second part (or front plate) 602 forming one side surface, a third part (or inclined plate) 603 inclined from the second part 602, a fourth part (or top plate) 604 parallel to the first part 601, and a fifth part (or rear plate) 605 forming another a side surface at a position facing the second part 602, with respect to the bent portion. The first to fifth parts 601, 602, 603, 604, and 605 may be formed in a shape that is continuously bent in order, and the overall shape may be formed to correspond to the side shape of the machine chamber 20. The reinforcement bracket 60 may be disposed on the side of the side cover 53 and may have a corresponding size.

In detail, the first part 601 may be positioned at a position corresponding to and may have a corresponding length to a lower end of the side cover 53, the second part 602 may be positioned at a position corresponding to and may have a corresponding length to a front end of the side cover 53, the third part 603 may be positioned at a position corresponding to and may have a corresponding length to an inclined portion of the side cover 53, the forth part 604 may be positioned at a position corresponding to and may have a corresponding length to an upper end of the side cover 53, and the fifth part 605 may be positioned at a position corresponding to and may have a corresponding length to a rear end of the side cover 53.

The length of the first part 601 may be slightly shorter than the lower end of the side cover 53, so that the lower end of the fifth part 605 and the rear end of the first part 601 are spaced apart from each other and thus spaced space 53 can be formed. End portions of the first part 601 and the fifth part 605 may be spaced apart from each other, and thus it may be possible to form the reinforcement bracket 60 by bending one sheet of material in order.

The first part 601 may be fixed to the horizontal support portion 311, and the fifth part 605 may be fixed to the vertical support portion 321. Accordingly, the horizontal support portion 311 and the vertical support portion 321 may have a structure connected to each other by the reinforcement bracket 60, and further, both side surfaces of the out case 11 in which the machine chamber 20 is located are even more reinforced. The reinforcement bracket 40 may be formed of a metal material or a composite material having high strength and the reinforcement bracket 40 may include a center part or plate 621 forming an overall shape, and a first side part or plate 622 and the second side part or plate 623 bent at both side surfaces of the center part 421.

In detail, the center part 621 may have a planar shape providing a surface in contact with the horizontal support portion 311 and the vertical support portion 321 and may be bent continuously so as to form the first to fifth parts 601, 602, 603, 604, and 605. The width of the center part 621 may be greater than or equal to the width of the horizontal support portion 311 and the vertical support portion 321. The width of the center part 621 may be smaller than that of the cover rear part 532 or the cover lower part 534 of the side cover 53 such that the reinforcement bracket 60 may have a shape which is received inward of the side cover 53.

Meanwhile, a recessed horizontal seating portion 624 may be formed at a position corresponding to the lower end of the second part 602 of the center part 621. The horizontal seating portion 624 may contact the horizontal stepped portion 312 when the reinforcement bracket 60 is mounted to the reinforcement frame 30. In other words, the horizontal seating portion 624 may be recessed to correspond to the protruding shape of the horizontal stepped portion 312, and thus the horizontal stepped portion 312 and the horizontal seating portion 624 may be configured to be in close contact with each other.

In addition, a recessed vertical seating portion 627 may be formed at a position corresponding to the front end of the fourth part 604 of the center part 621. The vertical seating portion 627 may contact the vertical stepped portion 323 when the reinforcement bracket 60 is mounted to the reinforcement frame 30. In other words, the vertical seating portion 627 may be recessed to correspond to the protruding shape of the vertical stepped portion 323, and thus the vertical stepped portion 322 and the vertical seating portion 627 may be configured to be in close contact with each other.

The reinforcement frame 30 and the reinforcement bracket 60 may be further in close contact with each other by the structure of the horizontal seating portion 624 and the vertical seating portion 627. As a result, the impact and load transmitted from the outside can be more effectively distributed, and thus the side reinforcement performance of the machine chamber may be significantly improved.

Meanwhile, a first side part 622 may be formed at one side end of both side ends of the center part 621 facing the machine chamber 20. The first side part 622 may be bent vertically from the center part 621 and may have a predetermined width. Therefore, when the side cover 53 is mounted, a surface in contact with the side cover 53 may be provided.

In addition, a bracket mounting portion 626 recessed inward may be formed in the first side part 622 formed at a position corresponding to the fifth part 605 of the first side part 622. The bracket mounting portion 626 may be equipped with an electrical component such as the reactor 24.

A second side part 623 may be formed at one side end of both side ends of the center part 621 toward the out case 11.

The second side part 623 may also be bent vertically from the center part 621 and may have a predetermined width. Therefore, the out case 11 may be substantially supported from the inside of the out case 11 in contact with the inner surface of the out case 11. In addition, the second side part 623 may be omitted at a position corresponding to the first part 601 of the second side part 623 to prevent interference with the horizontal stepped portion 312.

In addition, a side seating portion 625 may be formed at a lower end of the second side part 623 formed at a position corresponding to the second part 602 of the second side part 623. The side seating portion 625 may be in contact with the upper end of the horizontal reinforcing portion 313 of the horizontal portion 31. Accordingly, the outer side surface of the second side part 623 may have the same plane as the outer side surface of the horizontal reinforcement portion 313 and have a structure that is in contact with and supports the inside surface of the out case 11 at the same time. In addition, the second side part 623 formed at a position corresponding to the fifth part 605 of the second side part 623 may be bent in an inner region of the vertical support portion 321, and the vertical step and to be in contact with one side surface of the vertical portion 323.

Meanwhile, the plurality of first side parts 622 and second side parts 623 formed in the first to fifth parts 601, 602, 603, 604, and 605, respectively, may be formed to be inclined so that the parts that are bent and are continuously in contact with each other at the time of molding the reinforcement bracket 40 may be in contact with each other. The inclined end portions may be firmly fixed by bonding to each other.

Meanwhile, in the present disclosure, various other embodiments will be possible, in addition to the above-described embodiments. Another embodiment of the present disclosure is different only in the structure of the reinforcement bracket 40, all other configurations may be the same, the same reference numerals may be used for the same configuration, and the detailed description thereof will be omitted.

As illustrated in the drawing, the frame assembly according to another embodiment of the present disclosure may be composed of a combination of the reinforcement frame 30 and the reinforcement bracket 70. The reinforcement frame 30 may include the horizontal portion 31 and the vertical portion 32, and the structure thereof may be the same as the above-described embodiment. The reinforcement bracket 70 may be mounted to be connected to the horizontal portion 31 and the vertical portion 32, respectively, and may be disposed along the side circumference of the machine chamber 20 in a state of being coupled with the reinforcement frame 30 so that the strength of the side region of the machine chamber 20 can be reinforced.

The reinforcement bracket 70 may be formed at a position corresponding to the side surface of the machine chamber 20 and may be disposed along a side circumference of the machine chamber 20. The reinforcement bracket 70 may be formed to correspond to or may be somewhat larger than the size of the side region of the machine chamber 20. Therefore, it may be possible to reinforce the side portion of the machine chamber 20 which is not filled with the heat-insulating material and is connected to the horizontal portion 31 and the vertical portion 32 of the reinforcement frame 30 so that the side surface of the machine chamber 20 may be reinforced more effectively.

The reinforcement bracket 70 may be formed by bending a plate-shaped metal material and may be formed in a shape corresponding to the side surface of the machine chamber 20 or the side cover 53 as a whole. In addition, the bracket opening 71 may be formed at the center of the reinforcement bracket 70. The side grilles 51 may be disposed in an inner region of the bracket opening 71, and the air passing through the side grills 71 may be entered and exited.

The overall shape of the reinforcement bracket 70 may be configured with a first part (or bottom plate) 701 forming the bottom surface, a second part (or front plate) 702 forming one side surface, a third part (or inclined plate) 703 inclined at the second part 702, a third part (or top plate) 704 parallel to the first part 701, and a fifth part (or rear plate) 705 forming another side surface at a position facing the second part 702, with respect to the bent portion. The first to fifth parts 701, 702, 703, 704, and 705 may be formed in a shape that is continuously bent in order, and the overall shape may be formed to correspond to the side shape of the machine chamber 20. The reinforcement bracket 70 may be disposed on the side of the side cover 53 and may have a corresponding size.

In detail, the first part 701 may be positioned at a position corresponding to and may have a corresponding length to a lower end of the side cover 53, the second part 702 may be positioned at a position corresponding to and may have a corresponding length to a front end of the side cover 53, the third part 703 may be positioned at a position corresponding to and may have a corresponding length to an inclined portion of the side cover 53, the forth part 704 may be positioned at a position corresponding to and may have a corresponding length to an upper end of the side cover 53, and the fifth part 705 may be positioned at a position corresponding to and may have a corresponding length to a rear end of the side cover 53. Therefore, the reinforcement bracket may have a structure in which the bracket opening is formed at the center thereof and the first to fifth parts are continuously connected.

The first part 701 may be fixed to the horizontal support portion 311, and the fifth part 705 may be fixed to the vertical support portion 321. Accordingly, the horizontal support portion 311 and the vertical support portion 321 may have a structure connected to each other by the reinforcement bracket 70, and further, reinforce both side surfaces of the out case 11 in which the machine chamber 20 is located. The reinforcement bracket 70 may be formed of a metal material or a composite material having high strength and the reinforcement bracket 70 may include a center part 721 forming an overall shape, and a first side part 722 and the second side part 723 bent at both side surfaces of the center part 721.

In detail, the center part 721 may be formed in a planar shape providing a surface in contact with the horizontal support portion 311 and the vertical support portion 321 and may be bent continuously so as to form the first to fifth parts 701, 702, 703, 704, and 705. The width of the center part 721 may be greater than or equal to the width of the horizontal support portion 311 and the vertical support portion 321. The width of the center part 721 may be smaller than that of the cover rear part 532 or the cover lower part 534 of the side cover 53 such that the reinforcement bracket 70 may have a shape which is received inward of the side cover 53.

Meanwhile, a recessed horizontal seating portion 724 may be formed at a position corresponding to the lower end of the second part 702 of the center part 721. The horizontal seating portion 724 may be formed to contact the horizontal stepped portion 312 when the reinforcement bracket 70 is mounted to the reinforcement frame 30. In other words, the horizontal seating portion 724 may be recessed to correspond to the protruding shape of the horizontal stepped portion 312, and thus the horizontal stepped portion 312 and the horizontal seating portion 724 may be in close contact with each other.

In addition, a recessed vertical seating portion 727 may be formed at a position corresponding to the front end of the fourth part 704 of the center part 721. The vertical seating portion 727 may be formed to contact the vertical stepped portion 323 when the reinforcement bracket 70 is mounted to the reinforcement frame 30. In other words, the vertical seating portion 727 may be recessed to correspond to the protruding shape of the vertical stepped portion 323, and thus the vertical stepped portion 323 and the vertical seating portion 727 may be configured to be in close contact with each other.

The reinforcement frame 30 and the reinforcement bracket 70 may be further in close contact with each other by the structure of the horizontal seating portion 724 and the vertical seating portion 727. As a result, the impact and load transmitted from the outside may be more effectively distributed, and thus the side reinforcement performance of the machine chamber may be significantly improved.

Meanwhile, a first side part 722 may be formed at one side end of both side ends of the center part 721 facing the machine chamber 20. The first side part 722 may be bent vertically from the center part 721 and may have a predetermined width. Therefore, when the side cover 53 is mounted, a surface which is in contact with the side cover 53 may be provided.

In addition, a bracket mounting portion 726 recessed inward may be formed in the first side part 722 formed at a position corresponding to the fifth part 705 of the first side part 722. The bracket mounting portion 726 may be equipped with an electrical component such as the reactor 24.

A second side part 723 may be formed at one side end of both side ends of the center part 721 toward the out case 11. The second side part 723 may also be bent vertically from the center part 721 and may have a predetermined width. Therefore, the out case 11 may be substantially supported from the inside of the out case 11 in contact with the inner surface of the out case 11. The second side part 723 may be omitted at a position corresponding to the first part 701 of the second side part 723 to prevent interference with the horizontal stepped portion 312.

In addition, a side seating portion 725 may be formed at a lower end of the second side part 723 formed at a position corresponding to the second part 702 of the second side part 723. The side seating portion 725 may be formed to be in contact with the upper end of the horizontal reinforcing portion 313 of the horizontal portion 31. Accordingly, the outer side surface of the second side part 723 may have the same plane as the outer side surface of the horizontal reinforcement portion 313 and have a structure that is in contact with and supports the inside surface of the out case 11 at the same time.

In addition, the second side part 723 formed at a position corresponding to the fifth part 705 of the second side part 723 may be bent in an inner region of the vertical support portion 321, and the vertical step and to be in contact with one side surface of the vertical portion 323.

Meanwhile, the plurality of first side parts 722 and second side parts 723 formed in the first to fifth parts 701, 702, 703, 704, and 705, respectively, may be formed to be inclined so that the parts that are bent and are continuously in contact with each other at the time of molding the reinforcement bracket 40 may be in contact with each other. The inclined end portions may be firmly fixed by bonding to each other.

An object of an embodiment of the present disclosure is to provide a refrigerator that can reinforce the strength of the machine chamber. An object of an embodiment of the present disclosure is to provide a refrigerator that can improve the strength of a lower portion of a side surface of the refrigerator.

An object of an embodiment of the present disclosure is to provide a refrigerator that can improve the heat dissipation performance of the machine chamber at the same time to reinforce the strength of the machine chamber. An object of an embodiment of the present disclosure is to provide a refrigerator that can improve the heat dissipation performance of the machine chamber to improve the power consumption.

An object of an embodiment of the present disclosure is to provide a refrigerator that can improve the assembly workability of the machine chamber. An object of an embodiment of the present disclosure is to provide a refrigerator that can substantially expand electrical component mounting space inside the machine chamber without degrading the storage capacity and thermal insulation performance of the refrigerator. An object of an embodiment of the present disclosure is to provide a refrigerator that can secure a mounting space for the additional electrical components without changing the disposition structure of the machine chamber.

A refrigerator according to an embodiment of the present disclosure may include a plate-shaped out case configured to form an outer appearance of a cabinet in which storage space is formed; a machine chamber configured to be disposed at a lower end of a rear surface of the cabinet so as to be independent of storage space, the machine chamber being configured to receive a compressor and a condenser; frame assemblies configured to be provided at lower ends of both side surfaces of the out case; and a machine chamber member configured to be provided between the frame assemblies, the machine chamber member being configured to form an inner surface of the machine chamber, in which the frame assembly includes a reinforcement frame configured to be disposed along a lower end and a rear edge of the out case; and a reinforcement bracket configured to be coupled to the reinforcement frame, and the reinforcement bracket being configured to be disposed along circumferences of both side surfaces of the machine chamber in a left and right direction.

The reinforcement frame may include a horizontal portion configured to extend along lower ends of both side surfaces of the out case; and a vertical portion configured to be connected to a rear end of the horizontal portion, the vertical portion being configured to extend along rear ends of both side surfaces of the out case.

The horizontal portion and the vertical portion may be formed by bending a single metal plate multiple times. The reinforcement bracket may be formed to connect the horizontal portion and the vertical portion to each other. The reinforcement bracket may be bent a number of times so as to be disposed along the circumferences of both side surfaces of the machine chamber, spaces spaced apart from each other may be formed on both ends of the reinforcement brackets, and both spaced ends of the reinforcement brackets may be fixed to the horizontal portion and the vertical portion, respectively.

The reinforcement bracket may be composed of a plurality of portions coupled to the horizontal portion and the vertical portion, respectively, and the plurality of portions may be coupled to each other.

The reinforcement bracket may include a center part configured to be bent along circumferential shapes of both side surfaces of the machine chamber, the center part being configured to be coupled to the frame assembly, first side parts configured to be bent along one side end of the left and right sides of the center part, the first side parts being configured to support both side surfaces of the machine chamber member, and second side parts configured to be bent along the other side end of the left and right sides of the center part, the second side parts configured to support both side surfaces of the out case.

A bracket mounting portion on which an electrical component may be disposed may be formed in an inside of the reinforcement bracket between the first side part and the second side part. A bracket mounting portion on which a reactor is mounted may be recessed in the first side part.

The reinforcement frame may include reinforcement parts configured to be in contact with both side surfaces of the out case, and a support configured to extend in a direction intersecting the reinforcement part, the support being configured to be in contact with a bent end portion of the out case, in which the center part may be coupled to the support, and the second side part may be coupled with the reinforcement part.

The out case corresponding to the machine chamber may be provided with a side grille configured to provide a passage through which outside air is entered and exited, and the reinforcement bracket may be disposed along a circumference of the side grille to form a bracket opening communicating with an opening of the side grille.

In addition, a refrigerator according to an embodiment of the present disclosure may include a cabinet configured to include an out case forming an outer appearance and an inner case forming storage space, a machine chamber configured to be provided at a lower end of a rear surface of the cabinet independent from the storage space, a reinforcement frame configured to be coupled to both side surfaces of the out case to pass through lower ends and rear ends of both side surfaces of the machine chamber, side covers configured to be spaced apart from the out case, the side covers being configured to form both side surfaces of an inner portion of the machine chamber, a reinforcement bracket configured to be coupled to the reinforcement frame, the reinforcement bracket being configured to be disposed along a circumference of the side cover, and a main plate configured to be connected to the side covers on both sides thereof, the main plate being configured to form an upper surface and a rear surface of the machine chamber, in which the reinforcement frame and the reinforcement bracket may be provided between the out case and the side cover.

The reinforcement frame may include a vertical portion configured to extend along the rear end of the machine chamber, and a horizontal portion configured to extend from a lower end of the vertical portion along the lower end of the machine chamber. The reinforcement bracket may connect the vertical portion and the horizontal portion to each other.

The reinforcement bracket may include a center part configured to be formed along an edge of the side cover, the center part being configured to be coupled to the vertical portion and the horizontal portion, a first side part configured to be bent at one end of the center part, the first side part being configured to support an outer surface of the side cover; and a second side part configured to be bent at the other end of the center part, the second side part being configured to support the inner surface of the out case. A gasket which seals between the side cover and the reinforcement bracket may be provided between the side cover and the first side part.

The side cover may include a cover part configured to form an inner surface of the machine chamber, a cover rear part configured to be bent outward from a rear end of the cover part to shield the reinforcement bracket from the rear, and a cover lower part configured to be bent outward from a lower end of the cover part to shield the reinforcement bracket from the rear.

A case bent portion which is bent inward and on which the reinforcement frame is mounted may be formed in a rear end and a lower end of the out case and a slide groove which is recessed inward and into which the end portions of the cover rear part and the cover lower part are slidably inserted may be further formed along the case bent portion.

The reinforcement frame may include a support configured to be in contact with the case bent portion, a reinforcement portion configured to extend in a direction intersecting the support, the reinforcement portion being configured to be in contact with a side surface of the out case, and a stepped portion configured to connect the support and the reinforcement portion, the stepped portion being configured to be formed so as to be stepped, and the stepped portion may form a space for receiving the slide groove when the reinforcement frame and the out case are coupled to each other.

The out case corresponding to the machine chamber may be provided with a side grille that provides a passage through which outside air is entered and exited, the reinforcement bracket may be disposed along a circumference of the side grille to form a bracket opening communicating with an opening of the side grille, and a cover opening which may communicate with the bracket opening is formed in the side cover.

The refrigerator according to the embodiment of the present disclosure can expect the following effects.

A reinforcement frame extending along the end portion of the out case is provided at the lower end of the rear surface of the outer case where the machine chamber is disposed, and a reinforcement bracket is further provided along the circumferences of both side surfaces of the machine chamber. The reinforcement bracket may be coupled to the reinforcement frame, so that the strength of the lower ends of both side surfaces of the cabinet where the machine chamber is located may be effectively reinforced.

In particular, there are advantages that the reinforcement frame may be composed of a vertical portion and a horizontal portion to pass through the rear end and the lower end of the machine chamber, and the reinforcement bracket may be configured in the form of connecting the vertical portion and the horizontal portion to each other to significantly improve the strength of the lateral direction of the machine chamber.

Due to the disposition of the reinforcement frame and the reinforcement bracket, both side surfaces of the machine chamber may secure sufficient strength, and thus, there may be an advantage of not having to dispose the heat-insulating material for strength reinforcement on both side surfaces of the machine chamber.

Due to the sufficient strength secured by the reinforcement frame and the reinforcement bracket, the size of the machine chamber may be formed to the smallest size that can dispose components, such as a compressor, condenser, and the like, and structural strength problems are not generated even if the size of the machine chamber decreases.

Therefore, there may be an advantage that, while maintaining the overall size of the refrigerator, the capacity of the storage space may be secured by securing a substantial additional space through the reduction of the machine chamber, and the effect of improving power consumption by increasing the thickness of the heat-insulating material disposed around the storage space can be expected. In addition, since the heat-insulating material is not disposed on both sides of the machine chamber, heat dissipation of the machine chamber may be more effectively performed, and thus an improvement in power consumption can be expected.

In addition, since the shape of the reinforcement bracket may be disposed along the circumference of the machine chamber without the heat-insulating material disposed on both sides of the machine chamber, openings for additional heat dissipation may be formed on both side surfaces of the machine chamber, and there may be no structural limitation in forming the openings for the additional heat dissipation. Therefore, there may be an advantage that the power consumption can be remarkably improved by securing additional heat dissipation structure at the same time as securing mechanical strength.

In addition, when the reinforcement bracket is disposed, a space of an inner region of the reinforcement bracket may be secured, and thus, a disposition space of a front component such as a reactor that may be additionally disposed inside the machine chamber may be secured.

Thus, basically, in addition to the electrical components installed in the machine chamber, it may be possible to additionally dispose electrical components in the machine chamber, and in particular, space that can dispose the additional electrical components may be secured without changing the structure for the disposition or disposition of the components disposed in the existing machine chamber, and there may be an advantage that it can be additionally mounted at any time without interference with components already mounted inside the machine chamber.

In addition, there may be an advantage that the additional electrical components thus mounted may be covered by the side cover, and electrical components that can be restricted from external exposure for safety or appearance can also be effectively mounted. In addition, the reinforcement frame and the reinforcement bracket may be mounted to the out case in an assembled state coupled to each other, and the side cover and the main plate may also be mounted in a module form, thereby improving the assembly workability of the refrigerator.

In particular, the assembly of the structure for foaming and additional heat dissipation on the side of the machine chamber may not be necessary, and the machine chamber module in a module state may be inserted into the out cabinet, in a slide-in manner, in which the reinforcement frame and the reinforcement bracket are mounted and be mounted and thus the work becomes easier and the productivity can be improved.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

an outer case configured to form an outer appearance of a cabinet in which a storage space is formed;

a machine chamber provided at a lower end of a rear of the outer case, the machine chamber being configured to receive a compressor and a condenser and including a main plate, a base plate, and first and second side covers that define the machine chamber; and a first frame assembly provided at a lower end of a first side surface of the outer case and a second frame assembly provided at the lower end of a second side surface of the outer case, wherein each of the first and second frame assemblies includes:

a reinforcement frame provided along a lower edge and a rear edge of the outer case; and a reinforcement bracket attached to the reinforcement frame, the reinforcement bracket being provided between the outer case and a respective side cover of the machine chamber.

2. The refrigerator of claim 1, wherein each of the reinforcement frames of the first and second frame assemblies includes:

a horizontal portion that extends along a lower end of a respective side surface of the outer case; and a vertical portion connected to a rear end of the horizontal portion, the vertical portion extending along a rear edge of the respective side surface of the outer case.

3. The refrigerator of claim 2, wherein the horizontal portion and the vertical portion are formed by bending a single metal plate multiple times.

4. The refrigerator of claim 2, wherein each of the reinforcement brackets of the first and second frame assemblies is attached to both the horizontal portion and the vertical portion of a corresponding one of the reinforcement brackets.

5. The refrigerator of claim 4, wherein each of the reinforcement brackets of the first and second frame assemblies is bent a plurality of times so as to be disposed adjacent to an edge of the main plate of the machine chamber, wherein a first end of each of the reinforcement brackets is spaced apart from a second end of the reinforcement bracket, and wherein the first end of each of the reinforcement brackets is attached to the horizontal portion of a corresponding one of the reinforcement brackets and the second end of the reinforcement bracket is attached to the vertical portion of the corresponding one of the reinforcement brackets.

6. The refrigerator of claim 4, wherein each of the reinforcement brackets of the first and second frame assemblies includes a plurality of plates attached to the corresponding horizontal portion and the corresponding vertical portion, respectively, and the plurality of plates are attached to each other.

7. The refrigerator of claim 1, wherein each of the reinforcement brackets of the first and second frame assemblies includes:

a center plate having a shape corresponding to an outer edge of the machine chamber;

a first side plate bent along a first side of the center plate, the first side plate being attached to the main plate; and a second side plate bent along a second side of the center plate, the second side plate being attached to the outer case.

8. The refrigerator of claim 7, wherein each of the reinforcement brackets of the first and second frame assemblies includes a bracket mount on which an electrical component is mounted.

9. The refrigerator of claim 7, wherein each of the reinforcement brackets of the first and second frame assemblies includes a bracket mount formed on the first side plate and on which a reactor is mounted.

10. The refrigerator of claim 7, wherein each of the reinforcement frames of the first and second frame assemblies includes:

a reinforcement plate in contact with the outer case, and a support plate that is perpendicular to the reinforcement plate, the support plate being in contact with a bent end of the outer case, wherein the center plate is attached to the support plate, and wherein the second side plate is attached to the reinforcement plate.

11. The refrigerator of claim 1, wherein the outer case includes a side grille that allows air to enter and exit the machine chamber, and wherein each of the reinforcement brackets of the first and second frame assemblies is provided along a circumference of the side grille to form a bracket opening that communicates with the side grille.

12. A refrigerator comprising:

a cabinet that includes an outer case that forms an outer appearance of the cabinet and an inner case that forms a storage space;

a machine chamber provided at a lower end of a rear of the outer case;

a first reinforcement frame attached to a first side surface of the outer case and a second reinforcement frame attached to a second side surface of the outer case, the first and second reinforcement frames being adjacent to a lower end and a rear end of the machine chamber;

a first side cover and a second side cover spaced apart from the outer case, the first and second side covers being configured to form side surfaces of the machine chamber;

a first reinforcement bracket attached to the first reinforcement frame and a second reinforcement bracket attached to the second reinforcement frame, the first and second reinforcement brackets being provided along an outer edge of the first and second side covers, respectively; and a main plate configured to be connected to the first and second side covers, the main plate forming an upper surface and a rear surface of the machine chamber, wherein the first and second reinforcement frames and the first and second reinforcement brackets are provided between the outer case and the first and second side covers, respectively.

13. The refrigerator of claim 12, wherein each of the first and second reinforcement frames includes;

a vertical portion that extends along a rear edge of the machine chamber; and a horizontal portion that extends from a lower end of the vertical portion along the lower end of the machine chamber.

14. The refrigerator of claim 13, wherein the first reinforcement bracket connects the vertical portion and the horizontal portion of the first reinforcement portion to each other, and the second reinforcement bracket connects the vertical portion and the horizontal portion of the second reinforcement portion to each other.

15. The refrigerator of claim 13, wherein each of the first and second reinforcement brackets includes:

a center plate that is adjacent to an edge of a respective side cover, the center plate being coupled to the vertical plate and the horizontal plate;

a first side plate bent at a first end of the center plate, the first side plate being attached to an outer surface of the respective side cover; and a second side plate bent at a second end of the center plate, the second side plate being attached to an inner surface of the outer case.

16. The refrigerator of claim 15, further comprising a gasket which provides a seal between each of the first and second side covers and each of the first and second reinforcement brackets, respectively.

17. The refrigerator of claim 12, wherein each of the first and second side covers includes:

a cover plate that forms an inner surface of the machine chamber;

a cover rear plate that is bent outward from a rear end of the cover plate to shield a rear of the reinforcement bracket; and a cover lower plate bent outward from a lower end of the cover plate to shield a bottom of the reinforcement bracket.

18. The refrigerator of claim 17, wherein the outer case is bent inward to form an outer case lip and each of the first and second reinforcement frames is mounted on the outer case lip, wherein each of the cover rear plate and the cover lower plate includes a cover insertion tab, and wherein the outer case lip includes a slide groove which is recessed inward and into which the cover insertion tabs of each of the cover rear plate and the cover lower plate are slidably inserted.

19. The refrigerator of claim 18, wherein each of the first and second reinforcement frames includes:

a support frame in contact with the outer case lip;

a reinforcement plate that extends in a direction perpendicular to the support, the reinforcement plate being in contact with a side surface of the outer case; and a step that connects the support plate and the reinforcement plate, and wherein the step forms a space into which the slide groove is received when the first and second reinforcement frames and the outer case are coupled to each other.

20. The refrigerator of claim 12, wherein the outer case includes a first side grille and a second side grille that allow air to enter and exit the machine chamber, wherein the first reinforcement bracket is provided along a circumference of the first side grille to form a first bracket opening communicating with an opening of the first side grille and the second reinforcement bracket is provided along a circumference of the second side grille to form a second bracket opening communicating with an opening of the second side grille, and wherein a first cover opening which communicates with the first bracket opening is formed in the first side cover and a second cover opening which communicates with the second bracket opening is formed in the second side cover.

* * * * *